US007058574B2

(12) United States Patent
Taniguchi et al.

(10) Patent No.: US 7,058,574 B2
(45) Date of Patent: Jun. 6, 2006

(54) SIGNAL PROCESSING APPARATUS AND MOBILE RADIO COMMUNICATION TERMINAL

(75) Inventors: Takayuki Taniguchi, Kawasaki (JP); Yuriko Tsukahara, Kawasaki (JP); Kimio Miseki, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 11/000,268

(22) Filed: Dec. 1, 2004

(65) Prior Publication Data

US 2005/0096904 A1 May 5, 2005

Related U.S. Application Data

(63) Continuation of application No. 09/852,235, filed on May 10, 2001, now abandoned.

(30) Foreign Application Priority Data

May 10, 2000 (JP) ..... 2000-137181

(51) Int. Cl.
*G10L 19/00* (2006.01)

(52) U.S. Cl. ..... 704/233

(58) Field of Classification Search ..... None
See application file for complete search history.

(56) References Cited

U.S. PATENT DOCUMENTS 5,659,622 A 8/1997 Ashley
5,812,970 A 9/1998 Chan et al.
6,122,384 A 9/2000 Mauro
6,141,639 A 10/2000 Thyssen
6,496,798 B1 12/2002 Huang et al.
6,604,070 B1 8/2003 Gao et al.
6,810,273 B1 * 10/2004 Mattila et al. ..... 455/570
6,925,435 B1 * 8/2005 Gao ..... 704/220
2001/0001853 A1 5/2001 Mauro et al.

FOREIGN PATENT DOCUMENTS

WO WO 99/01972 1/1999
WO WO 00/11650 3/2000

OTHER PUBLICATIONS

Patent Abstracts of Japan, JP 5-300209, Nov. 12, 1993.

* cited by examiner

*Primary Examiner*—Susan McFadden
(74) *Attorney, Agent, or Firm*—Oblon, Spivak, McClelland, Maier & Neustadt, P.C.

(57) ABSTRACT

In a signal processing apparatus, a speech coder includes, as three sections for coding speech data by different algorithm, an Algorithm-A coding section, an Algorithm-B coding section and an Algorithm-C coding section. A noise suppressor includes, as three sections for suppressing background noise by different algorithm, an Algorithm-X noise suppress section, an Algorithm-Y noise suppress section and an Algorithm-Z noise suppress section. A suppress algorithm switching control section controls switching on the basis of information from a coding algorithm switching control section such that an optimal one of the noise suppress sections may function in association with the coding section activated in the speech coder.

26 Claims, 20 Drawing Sheets

| | BAND 0 | BAND 1 | ··· | BAND M-1 |
|---|---|---|---|---|
| BIT RATE A | C(A,0) | C(A,1) | ··· | C(A,M-1) |
| BIT RATE B | C(B,0) | C(B,1) | ··· | C(B,M-1) |
| BIT RATE C | C(C,0) | C(C,1) | ··· | C(C,M-1) |

FIG. 17

| | BAND 0 | BAND 1 | ··· | BAND M-1 |
|---|---|---|---|---|
| BIT RATE A | C(A,0) | C(A,1) | ··· | C(A,M-1) |
| BIT RATE B | C(B,0) | C(B,1) | ··· | C(B,M-1) |
| BIT RATE C | C(C,0)=0 | C(C,1)=0 | ··· | C(C,M-1)=0 |

FIG. 18

| | BAND 0 | BAND 1 | ··· | BAND M-1 |
|---|---|---|---|---|
| BIT RATE A | C(A,0) | C(A,1) | ··· | C(A,M-1) |
| BIT RATE B | C(B,0) | C(B,1) | ··· | C(B,M-1)=0 |
| BIT RATE C | C(C,0) | C(C,1) | ··· | C(C,M-1) |

FIG. 19

SIGNAL PROCESSING APPARATUS AND MOBILE RADIO COMMUNICATION TERMINAL

CROSS-REFERENCE TO RELATED APPLICATIONS

The present patent document is a continuation of U.S. application Ser. No. 09/852,235, filed on May 10, 2001, now abandoned, and in turn claims the benefit of priority from the prior Japanese Patent Application No. 2000-137181, filed May 10, 2000, the entire contents of each of which are incorporated herein by reference.

BACKGROUND OF THE INVENTION

The present invention relates to a noise suppressor for reducing noise contained in transmitted/received speech signal, which is used in radio communication apparatuses of various digital communication methods, including a digital mobile phone system.

A telephone service using speech communication is known as a basic service of mobile communication. A mobile telephone system first began with an analog method, but now a digital method is prevailing.

In the digital method, an A/D converter is needed to convert analog speech signals to digital signals. However, simple A/D conversion requires a coding rate of about 100 kbps. Considering limited radio wave resources, it is necessary to compress the digital signals to 1/10 to *frax*;1;20. To meet the *demand*, a *high-efficiency* speech coding *method*, generally called speech *compression*, is employed and it is embodied as a speech CODEC.

In current mobile communications, a speech CODEC with a coding rate of about 3.5 kbps to 32 kbps is used. In the low-rate CODEC, the coding rate is decreased by utilizing the characteristics of speech signals as much as possible. As a result, even if an adequate quality of speech is obtained, the reproducibility and quality of "sound" other than speech tend to deteriorate.

A low-rate speech CODEC is used as an application in mobile phones which are often used outdoors. In some cases, mobile phones are used in an environment with large background noise.

If background noise is input to the low-rate speech CODEC which is designed mainly for "speech", the speech quality will vary. The clearness and quality of speech will deteriorate in the environment with background noise.

As techniques for solving this problem, attention has recently been paid to noise suppressors (or noise cancelers) which are designed to suppress background noise taken in through microphones and to deliver only speech to the speech CODEC.

For example, a noise canceler is described in the chapter "Half-Rate Speech CODEC" in the "Personal Digital Cellular Telecommunication System RCR STD-27" published by Association of Radio Industries and Businesses (ARIB) in Japan.

New speech CODECs have been developed by technical innovations. There is a recent trend of multi-mode, in other words multi-algorithm, wherein new CODECs are introduced in systems to achieve two-algorithm switching (two speech CODECs can be switched) or three-algorithm switching (three speech CODECs can be switched).

On the other hand, like EVRC (Enhanced Variable Rate Codec) known as the TIA (Telecommunications Industry Association) standard IS-127 in the U.S.A. or AMR (Adaptive Multi Rate), multi-rate systems have been proposed wherein one CODEC is used while plural different coding rates are supported. Moreover, a hands-free function that enables a user to make calls without having to lift his/her handset has been provided for the user's convenience.

However, in the conventional multi-mode or multi-rate communications apparatus, the noise suppressor may not fully function due to mismatching between the speech CODEC and noise suppressor in a certain selected mode or rate. As a result, high-quality transmitted speech or received speech cannot be obtained.

Furthermore, in the conventional communications apparatus with the hands-free function, in accordance with switching between the hands-free algorithm and non-hands-free algorithm, a speech input path to the noise suppressor may vary via a microphone, an analog amplifier, etc. or speech input characteristics may vary. Besides, if the environment of use changes, for example, when a new device such as an echo canceler is provided in the signal path for echo control, the noise suppressor cannot fully function and high-quality transmitted speech or received speech cannot be obtained.

BRIEF SUMMARY OF THE INVENTION

The object of the present invention is to provide a signal processing apparatus and a mobile radio communication terminal wherein a noise suppressor can fully function and high-quality speech can be transmitted and received even if the settings for use are varied due to switching of algorithm and rates or switching between a hands-free operation and a non-hands-free operation.

In order to achieve the object, the invention of claim 1 provides a signal processing apparatus comprising: a noise suppressor having a plurality of different noise suppression characteristics, suppressing background noise contained in a speech signal; a speech encoder having a plurality of different coding algorithm, encoding the suppressed speech signal by using one of the different coding algorithm; and wherein the noise suppressor selects one noise suppression characteristic in accordance with the used coding algorithm at the speech encoder.

In the signal processing apparatus with this structure, in a case where plural different coding algorithm are selectively performed, a noise component contained in a speech signal is suppressed in a front stage in association with a coding algorithm performed in a rear stage.

According to the signal processing apparatus with this structure, since the noise component is suppressed in association with the coding algorithm, the noise component is fully suppressed even if the content of the coding algorithm is varied, and high-quality speech can be transmitted.

In order to achieve the object, the invention of claim 2 provides a signal processing apparatus comprising: a noise suppressor having a plurality of different noise suppression characteristics, suppressing background noise contained in a speech signal; a speech encoder having a plurality of different coding rates, encoding the suppressed speech signal by using one of the different coding rates; and wherein the noise suppressor selects one noise suppression characteristic in accordance with the used coding rate at the speech encoder.

In the signal processing apparatus with this structure, in a case where plural different coding rates are selectively performed, a noise component contained in a speech signal is suppressed in a front stage in association with a coding rate performed in a rear stage.

According to the signal processing apparatus with this structure, since the noise component is suppressed in association with the codings rate, the noise components is fully suppressed even if the coding rate is varied, and high-quality speech can be transmitted.

In addition, in order to achieve the object, the invention of claim 10 provides a signal processing apparatus comprising: a speech decoder having a plurality of different decoding algorithm, decoding the encoded speech signal by using one of the different decoding algorithm; a noise suppressor having a plurality of different noise suppression characteristics, suppressing noise component contained in the decoded speech signal; and wherein the noise suppressor selects one noise suppression characteristics in accordance with the used decoding algorithm at the speech encoder.

In the signal processing apparatus with this structure, plural different decoding algorithm are selectively performed. When a noise component contained in the speech signal is suppressed in a rear stage, noise component suppression is performed in accordance with the performed decoding algorithm.

According to the signal processing apparatus with this structure, since the noise component is suppressed in association with the decoding algorithm, the noise component is fully suppressed even if the content of the decoding algorithm is varied, and high-quality speech can be received.

In order to achieve the object, the invention of claim 19 provides a signal processing apparatus for use in a device in which a hands-free function is selectively usable, the apparatus comprising: a noise suppressor having at least two different noise suppression characteristics, suppressing background noise contained in a speech signal; and the noise suppressor having a switch which selects a suitable suppression characteristic from the different noise suppression characteristics in accordance with the use of the hands-free function.

In the signal processing apparatus with this structure, the noise component in the input speech signal is suppressed in a manner varying depending on whether or not the speech signal has been input with use of the hands-free function.

According to the signal processing apparatus with this structure, even if the signal input path is varied depending on whether or not the speech signal has been input with use of the hands-free function, the noise component is fully suppressed and high-quality speech can be received.

In order to achieve the object, the invention of claim 22 provides a mobile radio communication terminal having a signal processing apparatus, the signal processing apparatus comprising: a noise suppressor having a plurality of different noise suppression characteristics, suppressing background noise contained in a speech signal; a speech encoder having a plurality of different coding algorithm, encoding the suppressed speech signal by using one of the different coding algorithm; and wherein the noise suppressor selects one noise suppression characteristics in accordance with the used coding algorithm at the speech encoder.

In the mobile radio communication terminal with this structure, in a case where plural different coding algorithm are selectively performed, a noise component contained in a speech signal is suppressed in a front stage in association with a coding algorithm performed in a rear stage.

According to the mobile radio communication terminal with this structure, since the noise component is suppressed in association with the coding algorithm, the noise component is fully suppressed even if the content of the coding algorithm is varied, and high-quality speech can be transmitted.

In order to achieve the object, the invention of claim 23 provides a mobile radio communication terminal having a signal processing apparatus, the signal processing apparatus comprising: a noise suppressor having a plurality of different noise suppression characteristics, suppressing background noise contained in a speech signal; a speech encoder having a plurality of different coding rates, encoding the suppressed speech signal by using one of the different coding rates; and wherein the noise suppressor selects one noise suppression characteristics in accordance with the used coding rate at the speech encoder.

In the mobile radio communication terminal with this structure, plural different decoding rates are selectively performed. When a noise component contained in the speech signal is suppressed in a rear stage, noise component suppression is performed in accordance with the used coding rate at the speech encoder.

According to the mobile radio communication terminal with this structure, since the noise component is suppressed in association with the coding rate, the noise component is fully suppressed even if the coding rate is varied, and high-quality speech can be received.

In order to achieve the object, the invention of claim 24 provides a signal processing apparatus comprising: a noise suppressor having a plurality of different noise suppression characteristics, suppressing background noise contained in a speech signal, where the number of the noise suppression characteristics is Q (Q: a positive integer); a speech encoder having a plurality of different coding algorithm, encoding the suppressed speech signal by using one of the different coding algorithm, where the number of the coding algorithm is P (P: a positive integer); and wherein the noise suppressor selects one noise suppression characteristic in accordance with the used coding algorithm at the speech encoder, the following relationship is established: $P \geqq Q > 1$.

In the signal processing apparatus with this structure, in a case where coding processes of plural different coding algorithm are selectively performed, when a noise component contained in a speech signal is to be suppressed in a front stage, a noise suppressor for suppressing the noise component in association with the coding algorithm performed in a rear stage is selected from plural noise suppressors. The relationship between the number P of the coding algorithm and the number Q of the noise suppressors is set to be: $P \geqq Q > 1$.

According to the signal processing apparatus with this structure, even where the relationship between the number P of the coding algorithm and the number Q of the noise suppressors is set to be $P \geqq Q > 1$, the noise component can be suppressed in association with the coding algorithm. Therefore, even if the content of the coding algorithm is varied, the noise component is fully suppressed and high-quality speech can be transmitted.

In order to achieve the object, the invention of claim 25 provides a signal processing apparatus comprising: a noise suppressor having a plurality of different noise suppression characteristics, suppressing background noise contained in a speech signal, where the number of the noise suppression characteristics is Q (Q: a positive integer); a speech encoder having a plurality of different coding rates, encoding the suppressed speech signal by using one of the different coding rates, where the number of the coding rates is R (R: a positive integer); and wherein the noise suppressor selects one noise suppression characteristic in accordance with the used coding rate at the speech encoder, the following relationship is established: $R \geqq Q > 1$.

In the signal processing apparatus with this structure, in a case where coding algorithm of plural different coding rates are selectively performed, when a noise component contained in a speech signal is to be suppressed in a front stage, a noise suppressor for suppressing the noise component in association with the coding algorithm performed in a rear stage is selected from plural noise suppressors. The relationship between the number R of the coding rates and the number Q of the noise suppressors is set to be: $R \geqq Q > 1$.

According to the signal processing apparatus with this structure, even where the relationship between the number R of the coding rates and the number Q of the noise suppressors is set to be $R \geqq Q > 1$, the noise component can be suppressed in association with the coding algorithm. Therefore, even if coding rate is varied, the noise component is fully suppressed and high-quality speech can be transmitted.

In order to achieve the object, the invention of claim 26 provides a signal processing apparatus comprising: a noise suppressor having a plurality of different noise suppression characteristics, suppressing background noise contained in a speech signal, the noise suppression characteristics is varied in accordance with a parameter set by a parameter setting means; a speech encoder having a plurality of different coding algorithm, encoding the suppressed speech signal by using one of the different coding algorithm, where the number of the coding algorithm is P (P: a positive integer); and wherein the parameter setting means set a suitable parameter so as to select an optimal noise suppression characteristic in accordance with the used coding algorithm at the speech encoder, where the number of the parameter is S (S: a positive integer), the following relationship is established: $R \geqq S > 1$.

In the signal processing apparatus with this structure, in a case where coding processes of plural different coding algorithm are selectively performed, when a noise component contained in a speech signal is to be suppressed in a front stage, parameters are selected from plural parameters sets for a noise suppressor so that the noise suppressor may suppress the noise component with characteristics suitable for the coding algorithm performed in a rear stage. The relationship between the number P of the coding algorithm and the number S of parameter sets is set to be: $P \geqq S > 1$.

According to the signal processing apparatus with this structure, even where the relationship between the number P of the coding algorithm and the number S of the parameter sets is set to be $P \geqq S > 1$, the noise component can be suppressed in association with the coding algorithm. Therefore, even if the content of the coding algorithm is varied, the noise component is fully suppressed and high-quality speech can be transmitted.

In order to achieve the object, the invention of claim 27 provides a signal processing apparatus comprising: a noise suppressor having a plurality of different noise suppression characteristics, suppressing background noise contained in a speech signal, the noise suppression characteristics is varied in accordance with a parameter set by a parameter setting means; a speech encoder having a plurality of different coding rates, encoding the suppressed speech signal by using one of the different coding rates, where the number of the coding rates is R (R: a positive integer); and wherein the parameter setting means set a suitable parameter so as to select an optimal noise suppression characteristic in accordance with the used coding rate at the speech encoder, where the number of the parameter is S (S: a positive integer), the following relationship is established: $R \geqq S > 1$.

In the signal processing apparatus with this structure, in a case where coding algorithm of plural different coding rates are selectively performed, when a noise component contained in a speech signal is to be suppressed in a front stage, parameters are selected from plural parameter sets for a noise suppressor so that the noise suppressor may suppress the noise component with characteristics suitable for the coding algorithm performed in a rear stage. The relationship between the number R of the coding rates and the number S of parameter sets is set to be: $R \geqq S > 1$.

According to the signal processing apparatus with this structure, even where the relationship between the number R of the coding rates and the number S of the parameter sets is set to be $R \geqq S > 1$, the noise component can be suppressed in association with the coding algorithm. Therefore, even if coding rate is varied, the noise component is fully suppressed and high-quality speech can be transmitted.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 17 shows an example of parameters set in the noise suppressor shown in FIG. 16;

FIG. 18 shows another example of parameters set in the noise suppressor shown in FIG. 16;

FIG. 19 shows still another example of parameters set in the noise suppressor shown in FIG. 16;

DETAILED DESCRIPTION OF THE INVENTION

Embodiments of the present invention will now be described with reference to the accompanying drawings.

Figure 1:
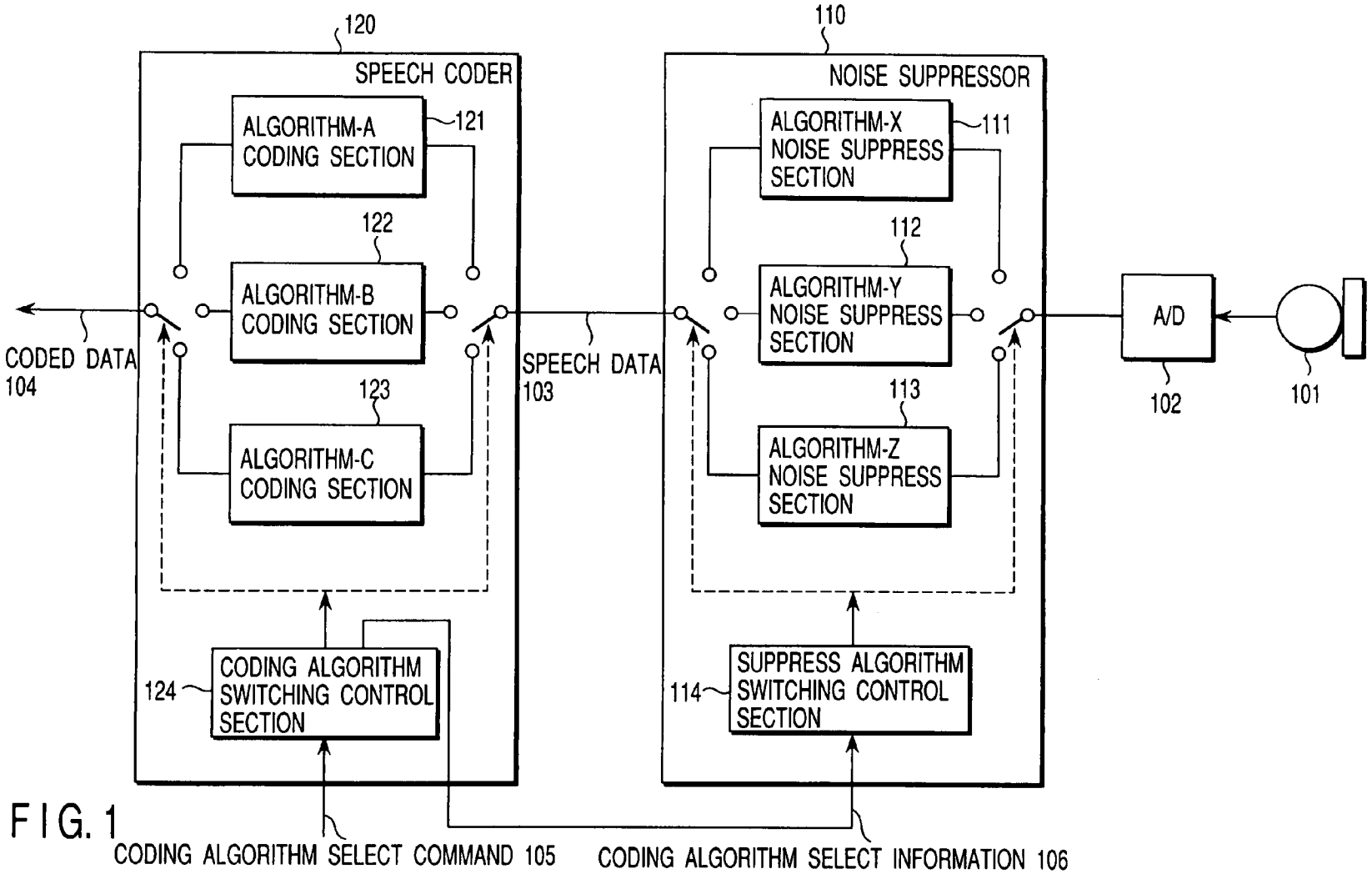
FIG. 1 is a section block diagram showing the structure of a signal processing apparatus according to a first embodiment of the present invention.

FIG. 1 shows the structure of a signal processing apparatus according to a first embodiment of the present invention.

Reference numeral 101 denotes a microphone for capturing a user's speech, converting it to an electric analog speech signal, and taking in the analog speech signal; 102 denotes an A/D converter for converting the analog speech signal taken in by the microphone 101 to digital speech data; 110 denotes a noise suppressor for suppressing background noise contained in the speech data by digital signal processing; 103 denotes speech data in which background noise has been suppressed by the noise suppressor 110; 120 denotes a speech coder for compressing and coding the digital speech data 103; and 104 denotes coded data compressed by the speech coder 120.

The speech coder 120 includes, as three sections for coding speech data by different algorithm, an Algorithm-A coding section 121, an Algorithm-B coding section 122 and an Algorithm-C coding section 123. In addition, the speech coder 120 includes a coding algorithm switching control section 124.

For example, the Algorithm-A coding section 121 performs a coding process in which the coding rate is low but the quality of coded sound relative to background noise is not good. The Algorithm-C coding section 123 performs a coding process in which the coding rate is high and the quality of coded sound relative to background noise is relatively good. The Algorithm-B coding section 122 performs a coding process capable of obtaining an intermediate speech quality between the Algorithm-A coding section 121 and the Algorithm-C coding section 123.

In response to an external coding algorithm select command 105, the coding algorithm switching control section 124 effects switching among the Algorithm-A coding section 121, Algorithm-B coding section 122 and Algorithm-C coding section 123 so that one of them may function. In addition, the coding algorithm switching control section 124 delivers information representative of the coding algorithm chosen by the switching to the noise suppressor 110 as coding algorithm select information 106.

The noise suppressor 110 includes, as three sections for suppressing background noise by different algorithm, an Algorithm-X noise suppress section 111, an Algorithm-Y noise suppress section 112 and an Algorithm-Z noise suppress section 113. Each noise suppress section has each different noise suppression characteristic. In addition, the noise suppressor 110 includes a suppress algorithm switching control section 114.

In response to the coding algorithm select information 106, the suppress algorithm switching control section 114 effects switching among the Algorithm-X noise suppress section 111, Algorithm-Y noise suppress section 112 and Algorithm-Z noise suppress section 113 so that an optimal one of them may function.

In the switching control by the suppress algorithm switching control section 114, the optimal noise suppress section (111, 112 or 113) is made to function in association with the coding section (121, 122 or 123) activated in the speech coder 120. Specifically, where the Algorithm-A coding section 121 functions, the Algorithm-X noise suppress section 111 is selected by the coding algorithm select information 106. Where the Algorithm-B coding section 122 functions, the Algorithm-Y noise suppress section 112 is selected by the coding algorithm select information 106. Where the Algorithm-C coding section 123 functions, the Algorithm-Z noise suppress section 113 is selected by the coding algorithm select information 106.

In order to optimize the correspondency between the coding section and the noise suppress section, the Algorithm-X noise suppress section 111, for example, adopts a spectral subtraction (SS) method in a frequency domain with a high noise suppress performance, although somewhat complex processing needs to be performed. The Algorithm-Y noise suppress section 112 adopts a similar SS method, in which, however, less complex processing needs to be performed than in the Algorithm-X noise suppress section 111. The Algorithm-Z noise suppress section 113 adopts an adaptive filtering method in a dime domain with a relatively simple scheme.

Figure 2:
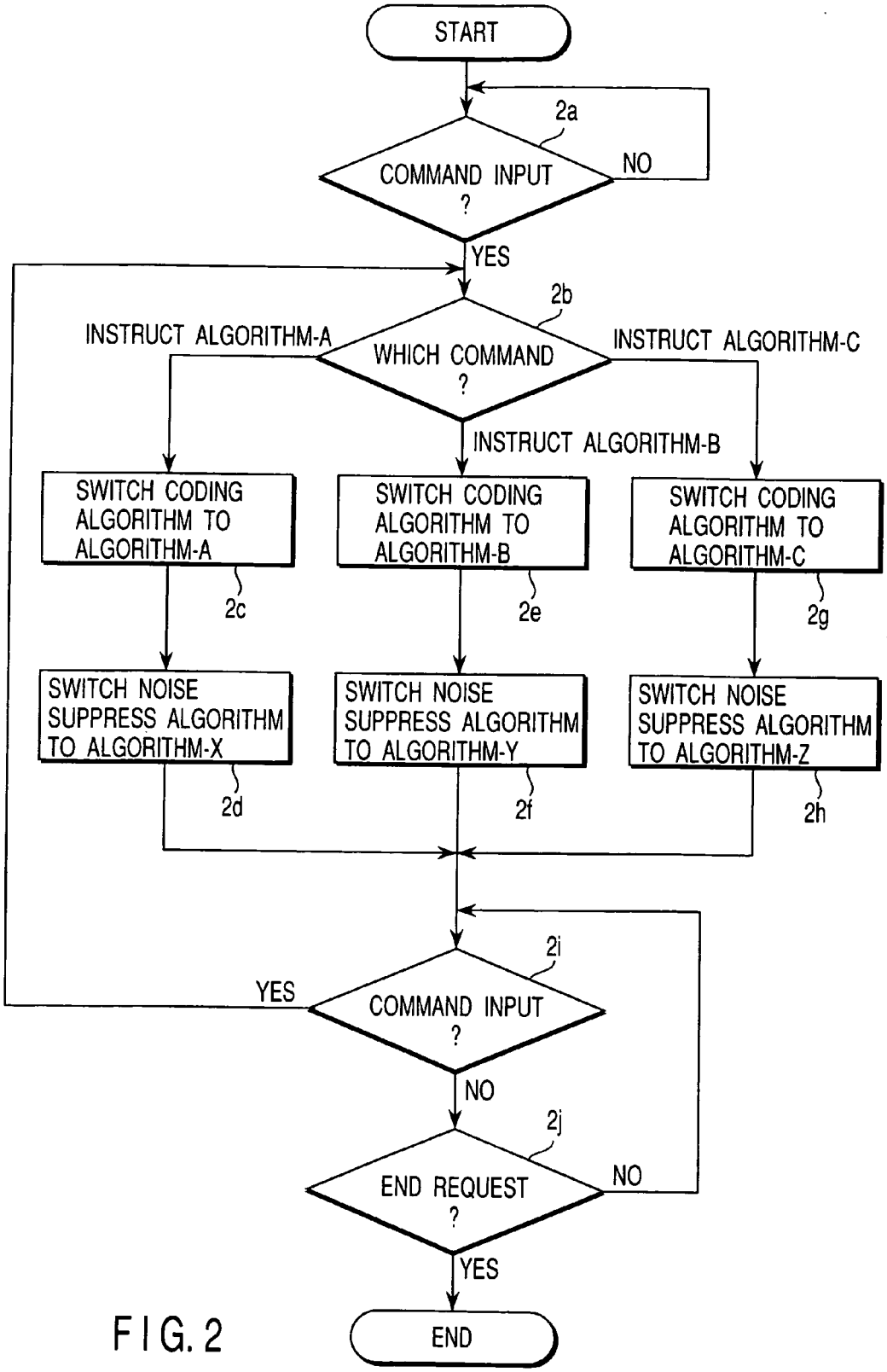
FIG. 2 is a flow chart illustrating the operation of the signal processing apparatus according to the first embodiment shown in FIG. 1.

The operation of the signal processing apparatus according to the first embodiment will now be described. FIG. 2 is a flow chart illustrating this operation.

In a command input standby state in step 2*a*, if the coding algorithm select command 105 to the effect that "Use the Algorithm-A as the coding algorithm" has been input to the coding algorithm switching control section 124, control advances to step 2*b* to determine the designated coding algorithm. Since the designated coding algorithm is the Algorithm-A in this case, control goes to step 2*c*.

In step 2*c*, the coding algorithm switching control section 124 controls switching so that the digital data 103 may be input to the Algorithm-A coding section 121. Accordingly, the Algorithm-A coding section 121 begins coding the input digital data 103.

In step 2*c*, in parallel with the switching control, the coding algorithm switching control section 124 outputs, as the coding algorithm select information 106, the information to the effect that the Algorithm-A coding section 121 is to be used for coding the digital data 103 to the suppress algorithm switching control section 114. Control then goes to step 2*d*.

In step 2*d*, the suppress algorithm switching control section 114 controls switching so that the output from the A/D converter 102 may enter the Algorithm-X noise suppress section 111, thereby effecting noise suppression by the Algorithm-X noise suppress section 111, which is optimized for the coding by the Algorithm-A coding section 121. Control then goes to step 2*i*.

With this switching control operation, the output from the A/D converter 102 is subjected to noise suppression in the Algorithm-X noise suppress section 111. The output from the Algorithm-X noise suppress section 111 is input to the Algorithm-A coding section 121 as digital data 103. The digital data 103 is coded in the Algorithm-A coding section 121 and the resultant data is output as coded data 104.

In step 2*i*, if the coding algorithm select command 105 to the effect that "Use the Algorithm-B as the coding algorithm" has been input to the coding algorithm switching control section 124, control advances to step 2*b* to determine the designated coding algorithm. Since the designated coding algorithm is the Algorithm-B in this case, control goes to step 2*e*.

In step 2*e*, the coding algorithm switching control section 124 controls switching at a proper timing so that the digital data 103 may be input to the Algorithm-B coding section 122. Accordingly, the Algorithm-A coding section. 121 stops functioning, and instead the Algorithm-B coding section 122 begins coding the input digital data 103.

In step 2*e*, in parallel with the switching control, the coding algorithm switching control section 124 outputs, as the coding algorithm select information 106, the information to the effect that the Algorithm-B coding section 122 is to be used for coding the digital data 103 to the suppress algorithm switching control section 114. Control then goes to step 2*f*.

In step 2*f*, the suppress algorithm switching control section 114 controls switching so that the output from the A/D converter 102 may enter the Algorithm-Y noise suppress section 112, thereby effecting noise suppression by the Algorithm-Y noise suppress section 112, which is optimized for the coding by the Algorithm-B coding section 122. Control then goes to step 2*i*.

With this switching control operation, the output from the A/D converter 102 is subjected to noise suppression in the Algorithm-Y noise suppress section 112. The output from the Algorithm-Y noise suppress section 112 is input to the Algorithm-B coding section 122 as digital data 103. The digital data 103 is coded in the Algorithm-B coding section 122 and the resultant data is output as coded data 104.

In step 2*i*, if the coding algorithm select command 105 to the effect that "Use the Algorithm-C as the coding algorithm" has been input to the coding algorithm switching control section 124 while the digital data 103 is being coded in the Algorithm-A coding section 121 or Algorithm-B coding section 122 as described above, control advances to step 2*b* to determine the designated coding algorithm. Since the designated coding algorithm is the Algorithm-C in this case, control goes to step 2*g*.

In step 2*g*, the coding algorithm switching control section 124 controls switching at a proper timing so that the digital data 103 may be input to the Algorithm-C coding section 123. Accordingly, the Algorithm-A coding section 121 or Algorithm-B coding section 122 stops functioning, and instead the Algorithm-C coding section 123 begins coding the input digital data 103.

In step 2*g*, in parallel with the switching control, the coding algorithm switching control section 124 outputs, as the coding algorithm select information 106, the information to the effect that the Algorithm-C coding section 123 is to be used for coding the digital data 103 to the suppress algorithm switching control section 114. Control then goes to step 2*h*.

In step 2*h*, the suppress algorithm switching control section 114 controls switching so that the output from the A/D converter 102 may enter the Algorithm-Z noise suppress section 113, thereby effecting noise suppression by the Algorithm-Z noise suppress section 113, which is optimized for the coding by the Algorithm-C coding section 123. Control then goes to step 2*i*.

With this switching control operation, the output from the A/D converter 102 is subjected to noise suppression in the Algorithm-Z noise suppress section 113. The output from the Algorithm-Z noise suppress section 113 is input to the Algorithm-C coding section 123 as digital data 103. The digital data 103 is coded in the Algorithm-C coding section 123 and the resultant data is output as compressed coded data 104.

In step 2*i*, if no command is input, control goes to step 2*j*. In step 2*j*, it is determined whether a communication end request is input. If the communication end request has been input, the present process is finished. If the communication end request is not input, command input is monitored once again in step 2*i*.

As has been described above, in the signal processing apparatus having the above structure, when the compressed coded data 104 is to be acquired, the optimal noise suppress section (111, 112 or 113) is activated in accordance with the coding section (121, 122 or 123) functioning in the speech coder 120.

According to the signal processing apparatus with the above structure, noise suppression is effected by the optimal noise suppress section for the coding by the speech coder 120. Thus, the noise suppress section functions with high performance, and high-quality speech can be transmitted.

The present invention is not limited to the above-described embodiment. For example, in the first embodiment, the suppress algorithm switching control section 114 functions to activate the optimal noise suppress section in accordance with the coding section functioning in the speech coder 120, on the basis of the coding algorithm select information 106 from the coding algorithm switching control section 124.

Instead, the suppress algorithm switching control section 114 may function to activate the optimal noise suppress section in accordance with the coding section functioning in the speech coder 120, on the basis of the coding algorithm select command 105. With this modification, the same advantage can also be obtained.

In this case, the suppress algorithm switching control section 114 controls switching to activate the optimal noise suppress section at a proper timing in consideration of the switching timing of the coding section in the speech coder 120.

Figure 3:
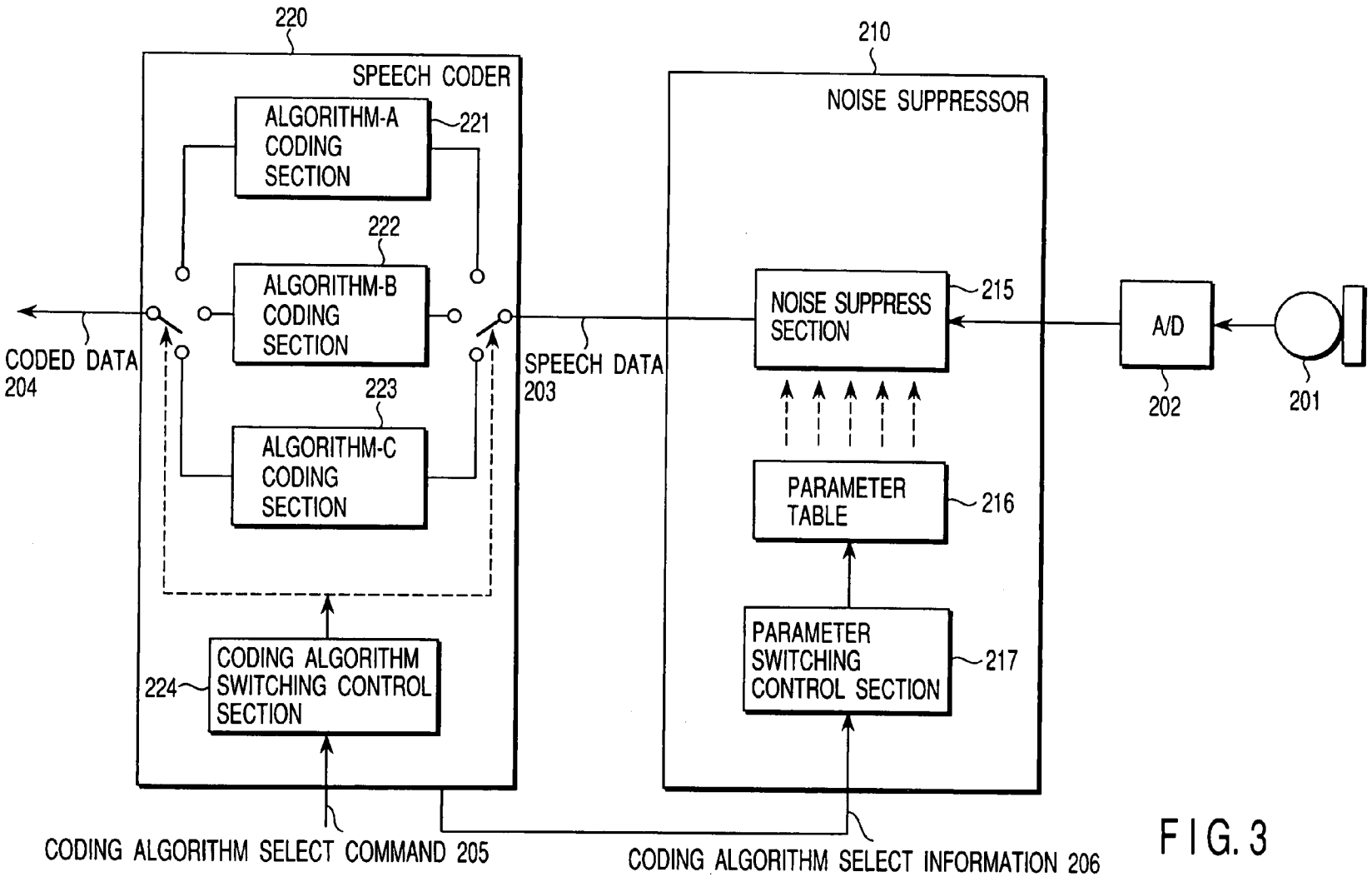
FIG. 3 is a section block diagram showing the structure of a signal processing apparatus according to a second embodiment of the present invention.

A signal processing apparatus according to a second embodiment of the present invention will now be described. FIG. 3 shows the structure of this signal processing apparatus.

Reference numeral 201 denotes a microphone for capturing a user's call speech, converting it to an electric analog speech signal, and taking in the analog speech signal; 202 an A/D converter for converting the analog speech signal taken in by the microphone 201 to digital speech data; 210 a noise suppressor for suppressing background noise contained in the speech data by digital signal processing; 203 speech data in which background noise has been suppressed by the noise suppressor 210; 220 a speech coder for compressing and coding the digital speech data 203; and 204 coded data compressed by the speech coder 220.

The speech coder 220 includes, as three sections for coding speech data by different algorithm, an Algorithm-A coding section 221, an Algorithm-B coding section 222 and an Algorithm-C coding section 223. In addition, the speech coder 220 includes a coding algorithm switching control section 224.

For example, the Algorithm-A coding section 221 performs a coding process in which the coding rate is low but the quality of coded sound relative to background noise is not good. The Algorithm-C coding section 223 performs a coding process in which the coding rate is high and the quality of coded sound relative to background noise is relatively good. The Algorithm-B coding section 222 performs a coding process capable of obtaining an intermediate speech quality between the Algorithm-A coding section 221 and the Algorithm-C coding section 223.

In response to an external coding algorithm select command 205, the coding algorithm switching control section 224 effects switching among the Algorithm-A coding section 221, Algorithm-B coding section 222 and Algorithm-C coding section 223 so that one of them may function. In addition, the coding algorithm switching control section 224 delivers information representative of the coding algorithm chosen by the switching to the noise suppressor 210 as coding algorithm select information 206.

The noise suppressor 210 comprises a noise suppress section 215, a parameter table 216 and a parameter switching control section 217.

The noise suppress section 215 suppresses background noise contained in speech data output from the A/D converter 202. The suppression characteristics for background noise suppression are controlled by parameters input from the parameter table 216.

The parameter table 216 stores parameters for setting the characteristics for background noise suppression to be effected by the noise suppress section 215. Specifically, the parameter table 216 stores three parameter sets for providing optimal noise suppression characteristics for the respective coding algorithm of the Algorithm-A coding section 221, Algorithm-B coding section 222 and Algorithm-C coding section 223. An optimal one of the parameter sets is input to the noise suppress section 215 by the control of the parameter switching control section 217.

In the present embodiment, it is assumed that each parameter set comprises five parameters, and parameter sets (three in this embodiment) are prepared for the respective coding algorithm.

The parameter switching control section 217 controls the parameter table 216. Thus, based on the coding algorithm select information 206, one of the parameter sets, which is optimal for the coding section (221, 222 or 223) functioning in the speech coder 220, can be selectively set in the noise suppress section 215.

In order to optimize the correspondency between the coding section and the parameter setting (noise suppress characteristic setting) in the noise suppress section, the parameter set associated with the Algorithm-A coding section 221, for example, realizes such characteristics as to provide a relatively large noise suppression amount and to reduce noise as much as possible even if some distortion occurs in the speech component. The parameter set associated with the Algorithm-C coding section 223 realizes such characteristics as to provide a relatively small noise suppression amount and to pass noise which can be naturally heard.

The parameter set associated with the Algorithm-B coding section 222 provides intermediate characteristics between those for the Algorithm-A coding section 221 and those for the Algorithm-C coding section 223.

Figure 4:
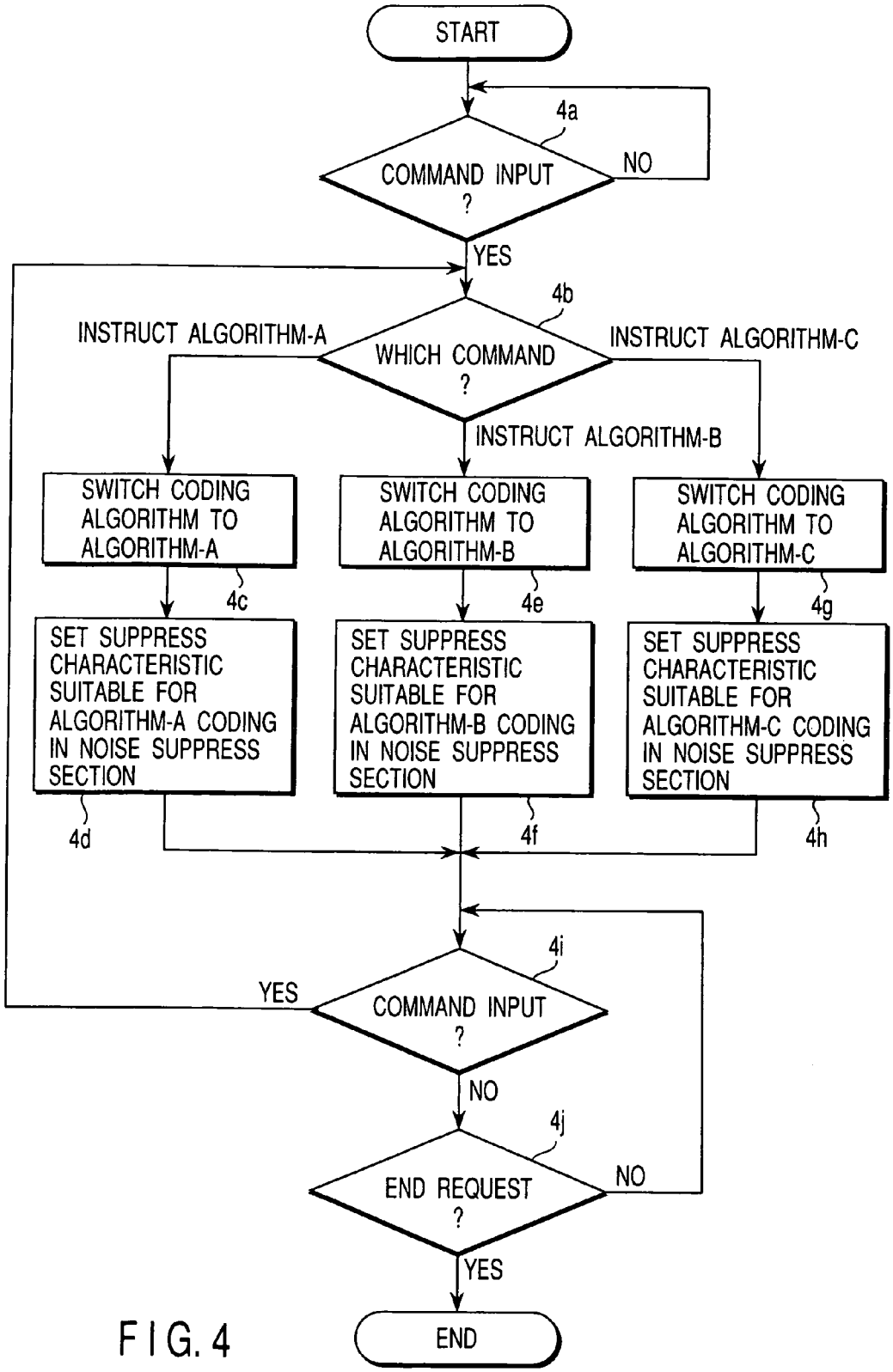
FIG. 4 is a flow chart illustrating the operation of the signal processing apparatus according to the second embodiment shown in FIG. 3.

The operation of the signal processing apparatus according to the second embodiment will now be described. FIG. 4 is a flow chart illustrating this operation.

In a command input standby state in step 4*a*, if the coding algorithm select command 205 to the effect that "Use the Algorithm-A as the coding algorithm" has been input to the coding algorithm switching control section 224, control advances to step 4*b* to determine the designated coding algorithm. Since the designated coding algorithm is the Algorithm-A in this case, control goes to step 4*c*.

In step 4*c*, the coding algorithm switching control section 224 controls switching so that the digital data 203 may be input to the Algorithm-A coding section 221. Accordingly, the Algorithm-A coding section 221 begins coding the input digital data 203.

In step 4*c*, in parallel with the switching control, the coding algorithm switching control section 224 outputs, as the coding algorithm select information 206, the information to the effect that the Algorithm-A coding section 221 is to be used for coding the digital data 203 to the parameter switching control section 217. Control then goes to step 4*d*.

In step 4*d*, the parameter switching control section 217 controls the parameter table 216 to input the parameter set associated with the Algorithm-A coding section 221 to the noise suppress section 215, so that the noise suppression characteristics of the noise suppress section 215 may become optimal for the coding by the Algorithm-A coding section 221. Control then goes to step 4*i*.

With this parameter setting (suppression characteristic setting) control operation, the output from the A/D converter 202 is subjected to noise suppression with the suppression characteristics suitable for the coding by the Algorithm-A coding section 221. The output from the noise suppress section 215 is input to the Algorithm-A coding section 221 as digital data 203. The digital data 203 is coded in the Algorithm-A coding section 221 and the resultant data is output as compressed coded data 204.

In step 4*i*, if the coding algorithm select command 205 to the effect that "Use the Algorithm-B as the coding algorithm" has been input to the coding algorithm switching control section 224, control advances to step 4*b* to determine the designated coding algorithm. Since the designated coding algorithm is the Algorithm-B in this case, control goes to step 4*e*.

In step 4*e*, the coding algorithm switching control section 224 controls switching at a proper timing so that the digital data 203 may be input to the Algorithm-B coding section 222. Accordingly, the Algorithm-A coding section 221 stops functioning, and instead the Algorithm-B coding section 222 begins coding the input digital data 203.

In step 4*e*, in parallel with the switching control, the coding algorithm switching control section 224 outputs, as the coding algorithm select information 206, the information to the effect that the Algorithm-B coding section 222 is to be used for coding the digital data 203 to the parameter switching control section 217. Control then goes to step 4*f*.

In step 4*f*, the parameter switching control section 217 controls the parameter table 216 to input the parameter set associated with the Algorithm-B coding section 222 to the noise suppress section 215, so that the noise suppression characteristics of the noise suppress section 215 may become optimal for the coding by the Algorithm-B coding section 222. Control then goes to step 4*i*.

With this parameter setting (suppression characteristic setting) control operation, the output from the A/D converter 202 is subjected to noise suppression with the suppression characteristics suitable for the coding by the Algorithm-B coding section 222. The output from the noise suppress section 215 is input to the Algorithm-B coding section 222 as digital data 203. The digital data 203 is coded in the Algorithm-B coding section 222 and the resultant data is output as compressed coded data 204.

In step 4*i*, if the coding algorithm select command 205 to the effect that "Use the Algorithm-C as the coding algorithm" has been input to the coding algorithm switching control section 224 while the digital data 203 is being coded in the Algorithm-A coding section 221 or Algorithm-B coding section 222 as described above, control advances to step 4*b* to determine the designated coding algorithm. Since the designated coding algorithm is the Algorithm-C in this case, control goes to step 4*g*.

In step 4*g*, the coding algorithm switching control section 224 controls switching at a proper timing so that the digital data 203 may be input to the Algorithm-C coding section 223. Accordingly, the Algorithm-A coding section 221 or Algorithm-B coding section 222 stops functioning, and instead the Algorithm-C coding section 223 begins coding the input digital data 203.

In step 4*g*, in parallel with the switching control, the coding algorithm switching control section 224 outputs, as the coding algorithm select information 206, the information to the effect-that the Algorithm-C coding section 223 is to be used for coding the digital data 203 to the parameter switching control section 217. Control then goes to step 4*h*.

In step 4*h*, the parameter switching control section 217 controls the parameter table 216 to input the parameter set associated with the Algorithm-C coding section 223 to the noise suppress section 215, so that the noise suppression characteristics of the noise suppress section 215 may become optimal for the coding by the Algorithm-C coding section 223. Control then goes to step 4*i*.

With this parameter setting (suppression characteristic setting) control operation, the output from the A/D converter 202 is subjected to noise suppression with the suppression characteristics suitable for the coding by the Algorithm-C coding section 223. The output from the noise suppress section 215 is input to the Algorithm-C coding section 223 as digital data 203. The digital data 203 is coded in the Algorithm-C coding section 223 and the resultant data is output as compressed coded data 204.

In step 4*i*, if no command is input, control goes to step 4*j*. In step 4*j*, it is determined whether a communication end request is input. If the communication end request has been input, the present process is finished. If the communication end request is not input, command input is monitored once again in step 4*i*.

As has been described above, in the signal processing apparatus having the above structure, when the compressed coded data 204 is to be acquired, the parameters in the noise suppress section 215 are varied in accordance with the coding section (221, 222 or 223) functioning in the speech coder 220. Thereby, the noise suppression characteristics of the noise suppress section 215 are set to be optimal for the coding process.

According to the signal processing apparatus with the above structure, optimal noise suppression is effected for the coding by the speech coder 220. Thus, the noise suppress section functions with high performance, and high-quality speech can be transmitted.

The present invention is not limited to the above-described embodiment. For example, in the second embodiment, the parameter switching control section 217 functions to optimize the noise suppression characteristics of the noise suppress section 215 in accordance with the coding section functioning in the speech coder 220, on the basis of the coding algorithm select information 206 from the coding algorithm switching control section 224.

Instead, the parameter switching control section 217 may function to optimize the noise suppression characteristics of the noise suppress section 215 in accordance with the coding section functioning in the speech coder 220, on the basis of the coding algorithm select command 205. With this modification, the same advantage can also be obtained.

In this case, the parameter switching control section 217 performs a control to set the parameter set for obtaining the optimal noise suppression characteristics at a proper timing in consideration of the switching timing of the coding section in the speech coder 220.

Figure 5:
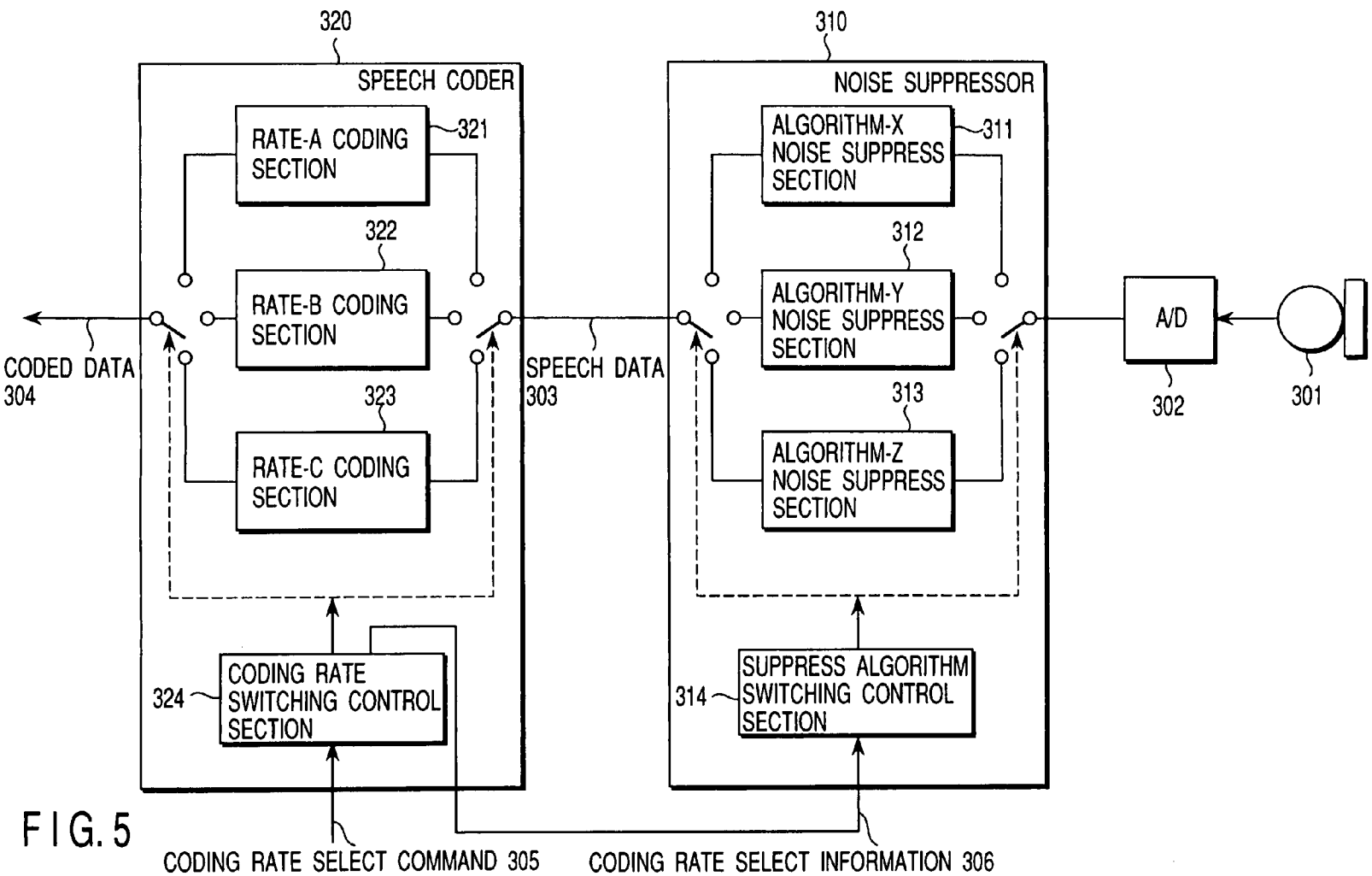
FIG. 5 is a section block diagram showing the structure of a signal processing apparatus according to a third embodiment of the present invention.

A signal processing apparatus according to a third embodiment of the present invention will now be described. FIG. 5 shows the structure of this signal processing apparatus.

Reference numeral 301 denotes a microphone for capturing a user's call speech, converting it to an electric analog speech signal, and taking in the analog speech signal; 302 an A/D converter for converting the analog speech signal taken in by the microphone 301 to digital speech data; 310 a noise suppressor for suppressing background noise contained in the speech data by digital signal processing; 303 speech data in which background noise has been suppressed by the noise suppressor 310; 320 a speech coder for compressing and coding the digital speech data 303; and 304 coded data compressed by the speech coder 320.

The speech coder 320 includes, as three sections for coding speech data by different coding rates, an rate-A coding section 321, a rate-B coding section 322 and a rate-C coding section 323. In addition, the speech coder 320 includes a coding rate switching control section 324.

For example, the rate-A coding section 321 has a lowest coding rate of the three coding sections. The rate-C coding section 323 has a highest coding rate of the three coding sections. The rate-B coding section 322 has an intermediate coding rate between the rate-A coding section 321 and the rate-C coding section 323.

In response to an external coding rate select command 305, the coding rate switching control section 324 effects switching among the rate-A coding section 321, rate-B coding section 322 and rate-C coding section 323 so that one of them may function. In addition, the coding rate switching control section 324 delivers information representative of the coding rate chosen by the switching to the noise suppressor 310 as coding rate select information 306.

The noise suppressor 310 includes, as three sections for suppressing background noise by different algorithm, an Algorithm-X noise suppress section 311, an Algorithm-Y noise suppress section 312 and an Algorithm-Z noise suppress section 313. In addition, the noise suppressor 310 includes a suppress algorithm switching control section 314.

In response to the coding rate select information 306, the suppress algorithm switching control section 314 effects switching among the Algorithm-X noise suppress section 311, Algorithm-Y noise suppress section 312 and Algorithm-Z noise suppress section 313 so that an optimal one of them may function.

In the switching control by the suppress algorithm switching control section 314, the optimal noise suppress section (311, 312 or 313) is made to function in association with the coding section (321, 322 or 323) activated in the speech coder 320. Specifically, where the rate-A coding section 321 functions, the Algorithm-X noise suppress section 311 is selected by the coding rate select information 306. Where the rate-B coding section 322 functions, the Algorithm-Y noise suppress section 312 is selected by the coding rate select information 306. Where the rate-C coding section 323 functions, the Algorithm-Z noise suppress section 313 is selected by the coding rate select information 306.

In order to optimize the correspondency between the coding section and the noise suppress section, the Algorithm-X noise suppress section 311, for example, adopts a spectral subtraction (SS) method in a frequency domain with a high noise suppress performance, although somewhat complex processing needs to be performed. The Algorithm-Y noise suppress section 312 adopts a similar SS method, in which, however, less complex processing needs to be performed than in the Algorithm-X noise suppress section 311. The Algorithm-Z noise suppress section 313 adopts an adaptive filtering method in a dime domain with a relatively simple scheme.

Figure 6:
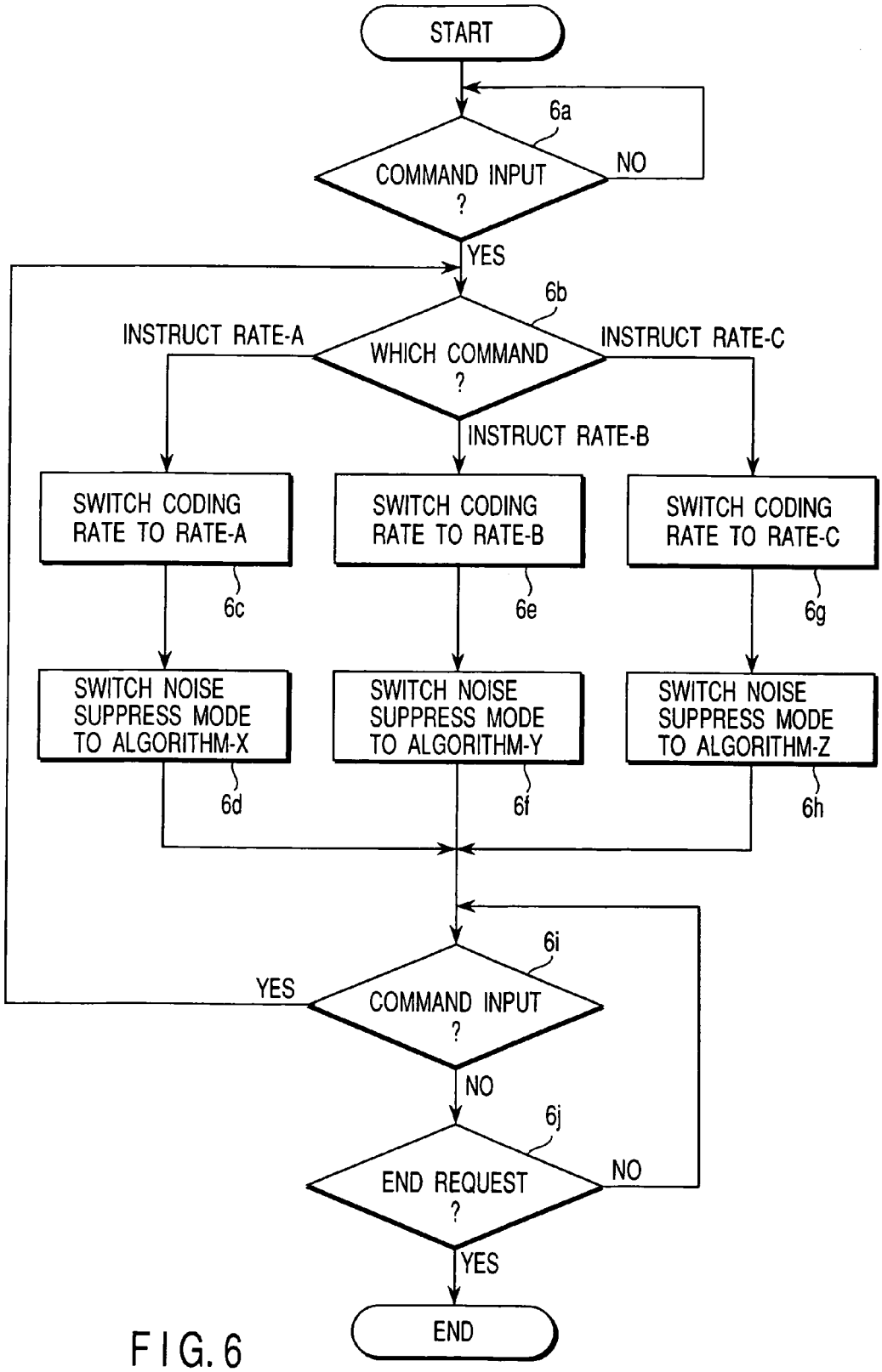
FIG. 6 is a flow chart illustrating the operation of the signal processing apparatus according to the third embodiment shown in FIG. 5.

The operation of the signal processing apparatus according to the third embodiment will now be described. FIG. 6 is a flow chart illustrating this operation.

In a command input standby state in step 6*a*, if the coding rate select command 305 to the effect that "Use the rate-A as the coding rate" has been input to the coding rate switching control section 324, control advances to step 6*b* to determine the designated coding rate. Since the designated coding rate is the rate-A in this case, control goes to step 6*c*.

In step 6*c*, the coding rate switching control section 324 controls switching so that the digital data 303 may be input to the rate-A coding section 321. Accordingly, the rate-A coding section 321 begins coding the input digital data 303.

In step 6*c*, in parallel with the switching control, the coding rate switching control section 324 outputs, as the coding rate select information 306, the information to the effect that the rate-A coding section 321 is to be used for coding the digital data 303 to the suppress algorithm switching control section 314. Control then goes to step 6*d*.

In step 6*d*, the suppress algorithm switching control section 314 controls switching so that the output from the A/D converter 302 may enter the Algorithm-X noise suppress section 311, thereby effecting noise suppression by the Algorithm-X noise suppress section 311, which is optimized for the coding by the rate-A coding section 321. Control then goes to step 6*i*.

With this switching control operation, the output from the A/D converter 302 is subjected to noise suppression in the Algorithm-X noise suppress section 311. The output from the Algorithm-X noise suppress section 311 is input to the rate-A coding section 321 as digital data 303. The digital data 303 is coded in the rate-A coding section 321 and the resultant data is output as compressed coded data 304.

In step 6*i*, if the coding rate select command 305 to the effect that "Use the rate-B as the coding rate" has been input to the coding rate switching control section 324, control advances to step 6*b* to determine the designated coding rate. Since the designated coding rate is the rate-B in this case, control goes to step 6*e*.

In step 6*e*, the coding rate switching control section 324 controls switching at a proper timing so that the digital data 303 may be input to the rate-B coding section 322. Accordingly, the rate-A coding section 321 stops functioning, and instead the rate-B coding section 322 begins coding the input digital data 303.

In step 6*e*, in parallel with the switching control, the coding rate switching control section 324 outputs, as the coding rate select information 306, the information to the effect that the rate-B coding section 322 is to be used for coding the digital data 303 to the suppress algorithm switching control section 314. Control then goes to step 6*f*.

In step 6*f*, the suppress algorithm switching control section 314 controls switching so that the output from the A/D converter 302 may enter the Algorithm-Y noise suppress section 312, thereby effecting noise suppression by the Algorithm-Y noise suppress section 312, which is optimized for the coding by the rate-B coding section 322. Control then goes to step 6*i*.

With this switching control operation, the output from the A/D converter 302 is subjected to noise suppression in the Algorithm-Y noise suppress section 312. The output from the Algorithm-Y noise suppress section 312 is input to the rate-B coding section 322 as digital data 303. The digital data 303 is coded in the rate-B coding section 322 and the resultant data is output as compressed coded data 304.

In step 6*i*, if the coding rate select command 305 to the effect that "Use the rate-C as the coding rate" has been input to the coding rate switching control section 324 while the digital data 303 is being coded in the rate-A coding section 321 or rate-B coding section 322 as described above, control advances to step 6*b* to determine the designated coding rate. Since the designated coding rate is the rate-C in this case, control goes to step 6*g*.

In step 6*g*, the coding rate switching control section 324 controls switching at a proper timing so that the digital data 303 may be input to the rate-C coding section 323. Accordingly, the rate-A coding section 321 or rate-B coding section 322 stops functioning, and instead the rate-C coding section 323 begins coding the input digital data 303.

In step 6*g*, in parallel with the switching control, the coding rate switching control section 324 outputs, as the coding rate select information 306, the information to the effect that the rate-C coding section 323 is to be used for coding the digital data 303 to the suppress algorithm switching control section 314. Control then goes to step 6*h*.

In step 6*h*, the suppress algorithm switching control section 314 controls switching so that the output from the A/D converter 302 may enter the Algorithm-Z noise suppress section 313, thereby effecting noise suppression by the Algorithm-Z noise suppress section 313, which is optimized for the coding by the rate-C coding section 323. Control then goes to step 6*i*.

With this switching control operation, the output from the A/D converter 302 is subjected to noise suppression in the Algorithm-Z noise suppress section 313. The output from the Algorithm-Z noise suppress section 313 is input to the rate-C coding section 323 as digital data 303. The digital data 303 is coded in the rate-C coding section 323 and the resultant data is output as compressed coded data 304.

In step 6*i*, if no command is input, control goes to step 6*j*. In step 6*j*, it is determined whether a communication end request is input. If the communication end request has been input, the present process is finished. If the communication end request is not input, command input is monitored once again in step 6*i*.

As has been described above, in the signal processing apparatus having the above structure, when the compressed coded data 304 is to be acquired, the optimal noise suppress section (311, 312 or 313) is activated in accordance with the coding section (321, 322 or 323) functioning in the speech coder 320.

According to the signal processing apparatus with the above structure, noise suppression is effected by the optimal noise suppress section for the coding by the speech coder 320. Thus, the noise suppress section functions with high performance, and high-quality speech can be transmitted.

The present invention is not limited to the above-described embodiment. For example, in the third embodiment, the suppress algorithm switching control section 314 functions to activate the optimal noise suppress section in accordance with the coding section functioning in the speech coder 320, on the basis of the coding rate select information 306 from the coding rate switching control section 324.

Instead, the suppress algorithm switching control section 314 may function to activate the optimal noise suppress section in accordance with the coding section functioning in the speech coder 320, on the basis of the coding rate select command 305. With this modification, the same advantage can also be obtained.

In this case, the suppress algorithm switching control section 314 controls switching to activate the optimal noise suppress section at a proper timing in consideration of the switching timing of the coding section in the speech coder 320.

Figure 7:
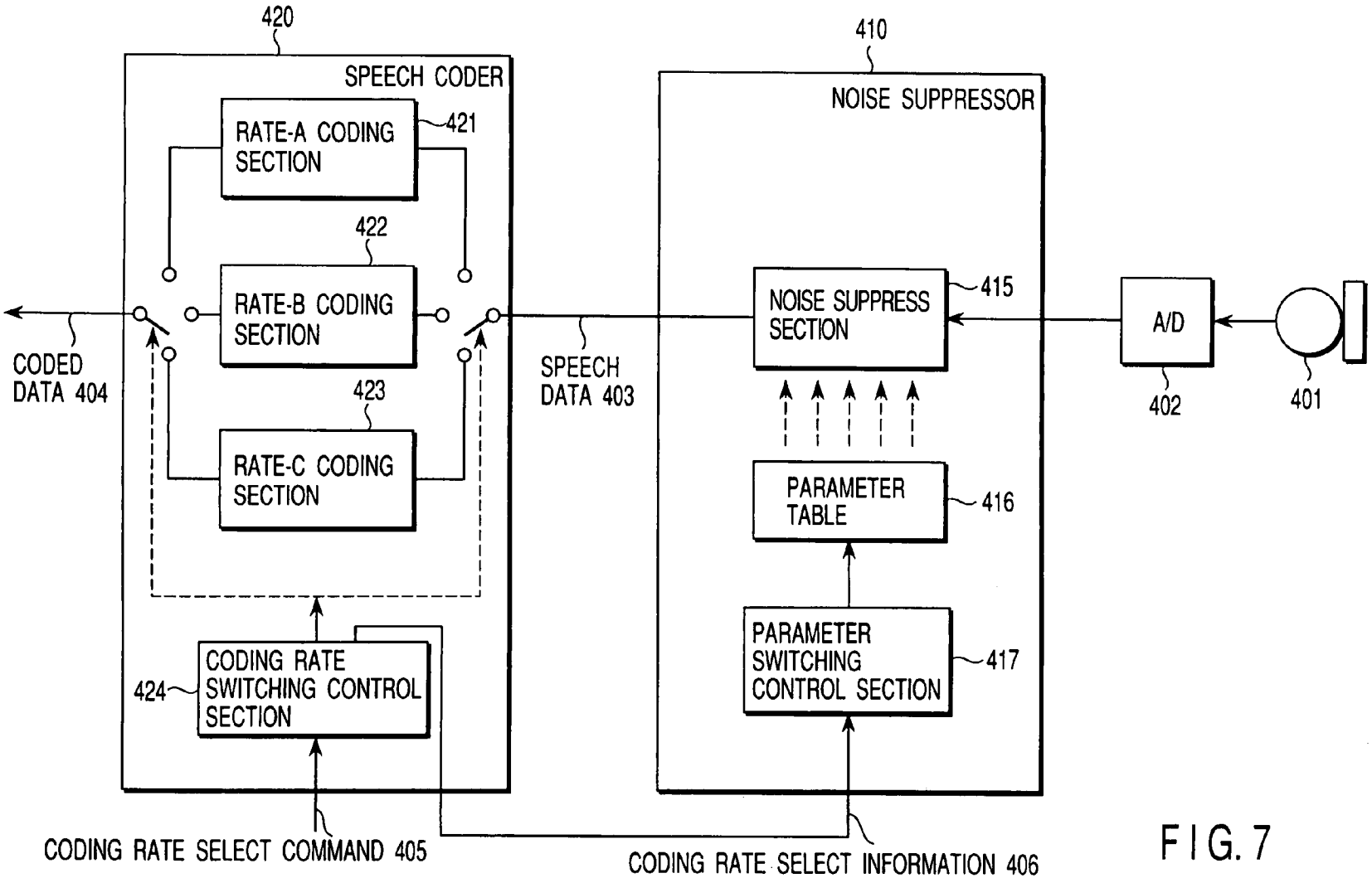
FIG. 7 is a section block diagram showing the structure of a signal processing apparatus according to a fourth embodiment of the present invention.

A signal processing apparatus according to a fourth embodiment of the present invention will now be described. FIG. 7 shows the structure of this signal processing apparatus.

Reference numeral 401 denotes a microphone for capturing a user's call speech, converting it to an electric analog speech signal, and taking in the analog speech signal; 402 an A/D converter for converting the analog speech signal taken in by the microphone 401 to digital speech data; 410 a noise suppressor for suppressing background noise contained in the speech data by digital signal processing; 403 speech data in which background noise has been suppressed by the noise suppressor 410; 420 a speech coder for compressing and coding the digital speech data 403; and 404 coded data compressed by the speech coder 420.

The speech coder 420 includes, as three sections for coding speech data by different coding rates, an rate-A coding section 421, a rate-B coding section 422 and a rate-C coding section 423. In addition, the speech coder 420 includes a coding rate switching control section 424.

For example, the rate-A coding section 421 has a lowest coding rate of the three coding sections. The rate-C coding section 423 has a highest coding rate of the three coding sections. The rate-B coding section 422 has an intermediate coding rate between the rate-A coding section 421 and the rate-C coding section 423.

In response to an external coding rate select command 405, the coding rate switching control section 424 effects switching among the rate-A coding section 421, rate-B coding section 422 and rate-C coding section 423 so that one of them may function. In addition, the coding rate switching control section 424 delivers information representative of the coding rate chosen by the switching to the noise suppressor 410 as coding rate select information 406.

The noise suppressor 410 comprises a noise suppress section 415, a parameter table 416 and a parameter switching control section 417.

The noise suppress section 415 suppresses background noise contained in speech data output from the A/D converter 402. The suppression characteristics for background noise suppression are controlled by parameters input from the parameter table 416.

The parameter table 416 stores parameters for setting the characteristics for background noise suppression to be effected by the noise suppress section 415. Specifically, the parameter table 416 stores three parameter sets for providing optimal noise suppression characteristics for the respective coding rates of the rate-A coding section 421, rate-B coding section 422 and rate-C coding section 423. An optimal one of the parameter sets is input to the noise suppress section 415 by the control of the parameter switching control section 417.

The parameter switching control section 417 controls the parameter table 416. Thus, based on the coding rate select information 406, one of the parameter sets, which is optimal for the coding section (421, 422 or 423) functioning in the speech coder 420, can be selectively set in the noise suppress section 415.

In order to optimize the correspondency between the coding section and the parameter setting (noise suppress characteristic setting) in the noise suppress section, the parameter set associated with the rate-A coding section 421, for example, realizes such characteristics as to provide a relatively large noise suppression amount and to reduce noise as much as possible even if some distortion occurs in the speech component. The parameter set associated with the rate-C coding section 423 realizes such characteristics as to provide a relatively small noise suppression amount and to pass noise which can be naturally heard.

The parameter set associated with the rate-B coding section 422 provides intermediate characteristics between those for the rate-A coding section 421 and those for the rate-C coding section 423.

Figure 8:
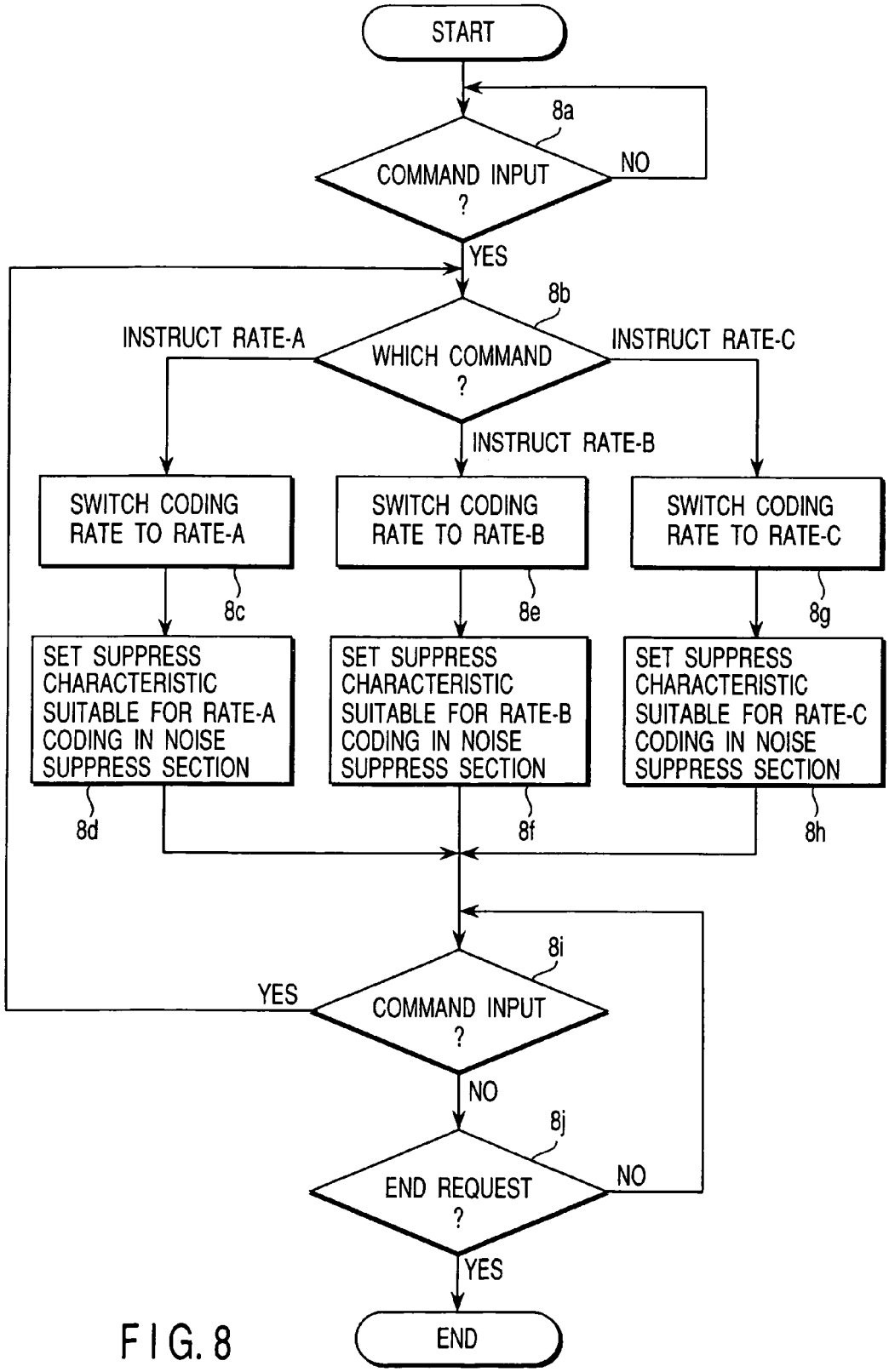
FIG. 8 is a flow chart illustrating the operation of the signal processing apparatus according to the fourth embodiment shown in FIG. 7.

The operation of the signal processing apparatus according to the fourth embodiment will now be described. FIG. 8 is a flow chart illustrating this operation.

In a command input standby state in step 8*a*, if the coding rate select command 405 to the effect that "Use the rate-A as the coding rate" has been input to the coding rate switching control section 424, control advances to step 8*b* to determine the designated coding rate. Since the designated coding rate is the rate-A in this case, control goes to step 8*c*.

In step 8*c*, the coding rate switching control section 424 controls switching so that the digital data 403 may be input to the rate-A coding section 421. Accordingly, the rate-A coding section 421 begins coding the input digital data 403.

In step 8*c*, in parallel with the switching control, the coding rate switching control section 424 outputs, as the coding rate select information 406, the information to the effect that the rate-A coding section 421 is to be used for coding the digital data 403 to the parameter switching control section 417. Control then goes to step 8*d*.

In step 8*d*, the parameter switching control section 417 controls the parameter table 416 to input the parameter set associated with the rate-A coding section 421 to the noise suppress section 415, so that the noise suppression characteristics of the noise suppress section 415 may become optimal for the coding by the rate-A coding section 421. Control then goes to step 8*i*.

With this parameter setting (suppression characteristic setting) control operation, the output from the A/D converter 402 is subjected to noise suppression with the suppression characteristics suitable for the coding by the rate-A coding section 421. The output from the noise suppress section 415 is input to the rate-A coding section 421 as digital data 403. The digital data 403 is coded in the rate-A coding section 421 and the resultant data is output as compressed coded data 404.

In step 8*i*, if the coding rate select command 405 to the effect that "Use the rate-B as the coding rate" has been input to the coding rate switching control section 424, control advances to step 8*b* to determine the designated coding rate. Since the designated coding rate is the rate-B in this case, control goes to step 8*e*.

In step 8*e*, the coding rate switching control section 424 controls switching at a proper timing so that the digital data 403 may be input to the rate-B coding section 422. Accordingly, the rate-A coding section 421 stops functioning, and instead the rate-B coding section 422 begins coding the input digital data 403.

In step 8*e*, in parallel with the switching control, the coding rate switching control section 424 outputs, as the coding rate select information 406, the information to the effect that the rate-B coding section 422 is to be used for coding the digital data 403 to the parameter switching control section 417. Control then goes to step 8*f*.

In step 8*f*, the parameter switching control section 417 controls the parameter table 416 to input the parameter set associated with the rate-B coding section 422 to the noise suppress section 415, so that the noise suppression characteristics of the noise suppress section 415 may become optimal for the coding by the rate-B coding section 422. Control then goes to step 8*i*.

With this parameter setting (suppression characteristic setting) control operation, the output from the A/D converter 402 is subjected to noise suppression with the suppression characteristics suitable for the coding by the rate-B coding section 422. The output from the noise suppress section 415 is input to the rate-B coding section 422 as digital data 403. The digital data 403 is coded in the rate-B coding section 422 and the resultant data is output as compressed coded data 404.

In step 8*i*, if the coding rate select command 405 to the effect that "Use the rate-C as the coding rate" has been input to the coding rate switching control section 424 while the digital data 403 is being coded in the rate-A coding section 421 or rate-B coding section 422 as described above, control advances to step 8*b* to determine the designated coding rate. Since the designated coding rate is the rate-C in this case, control goes to step 8*g*.

In step 8*g*, the coding rate switching control section 424 controls switching at a proper timing so that the digital data 403 may be input to the rate-C coding section 423. Accordingly, the rate-A coding section 421 or rate-B coding section 422 stops functioning, and instead the rate-C coding section 423 begins coding the input digital data 403.

In step 8*g*, in parallel with the switching control, the coding rate switching control section 424 outputs, as the coding rate select information 406, the information to the effect that the rate-C coding section 423 is to be used for coding the digital data 403 to the parameter switching control section 417. Control then goes to step 8*h*.

In step 8*h*, the parameter switching control section 417 controls the parameter table 416 to input the parameter set associated with the rate-C coding section 423 to the noise suppress section 415, so that the noise suppression characteristics of the noise suppress section 415 may become optimal for the coding by the rate-C coding section 423. Control then goes to step 8*i*.

With this parameter setting (suppression characteristic setting) control operation, the output from the A/D converter 402 is subjected to noise suppression with the suppression characteristics suitable for the coding by the rate-C coding section 423. The output from the noise suppress section 415 is input to the rate-C coding section 423 as digital data 403. The digital data 403 is coded in the rate-C coding section 423 and the resultant data is output as compressed coded data 404.

In step 8*i*, if no command is input, control goes to step 8*j*. In step 8*j*, it is determined whether a communication end request is input. If the communication end request has been input, the present process is finished. If the communication end request is not input, command input is monitored once again in step 8*i*.

As has been described above, in the signal processing apparatus having the above structure, when the compressed coded data 404 is to be acquired, the parameters in the noise suppress section 415 are varied in accordance with the coding section (421, 422 or 423) functioning in the speech coder 420. Thereby, the noise suppression characteristics of the noise suppress section 415 are set to be optimal for the coding process.

According to the signal processing apparatus with the above structure, optimal noise suppression is effected for the coding by the speech coder 420. Thus, the noise suppress section functions with high performance, and high-quality speech can be transmitted.

The present invention is not limited to the above-described embodiment. For example, in the fourth embodiment, the parameter switching control section 417 functions to optimize the noise suppression characteristics of the noise suppress section 415 in accordance with the coding section functioning in the speech coder 420, on the basis of the coding rate select information 406 from the coding rate switching control section 424.

Instead, the parameter switching control section 417 may function to optimize the noise suppression characteristics of the noise suppress section 415 in accordance with the coding section functioning in the speech coder 420, on the basis of the coding rate select command 405. With this modification, the same advantage can also be obtained.

In this case, the parameter switching control section 417 performs a control to set the parameter set for obtaining the optimal noise suppression characteristics at a proper timing in consideration of the switching timing of the coding section in the speech coder 420.

Figure 9:
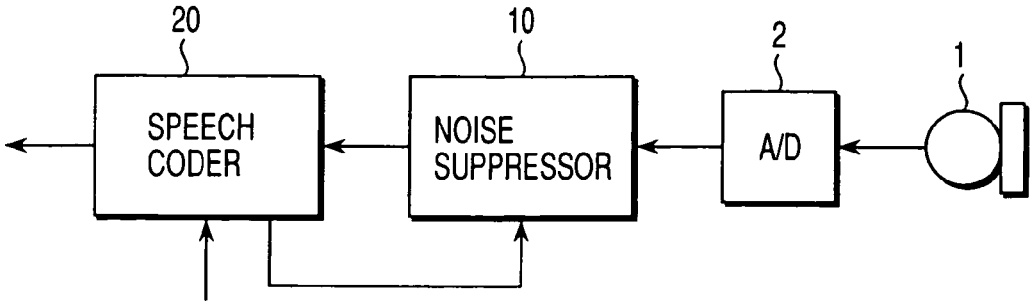
FIG. 9 shows a schematic structure of an input speech coding section, to which the signal processing apparatus of the present invention is applied.

As is epitomized in FIG. 9, in the first to fourth embodiments, speech to be transmitted is coded. In FIG. 9, reference numeral 1 denotes a microphone, and 2 an A/D converter. A noise suppressor 10 corresponds to the noise suppressor 110, 210, 310, 410, and a speech coder 20 corresponds to the speech coder 120, 220, 320, 420.

In the first and second embodiments, it is assumed that the number of coding algorithm (i.e. three; Algorithm-A, Algorithm-B, and Algorithm-C) is equal to the number of noise suppress algorithm (i.e. three; Algorithm-X, Algorithm-Y, and Algorithm-Z), and that the number of coding algorithm is equal to the number of parameter sets which are set in the noise suppress section.

In the third and fourth embodiments, too, it is assumed that the number of coding rates (i.e. three; rate-A, rate-B, and rate-C) is equal to the number of noise suppress algorithm (i.e. three; Algorithm-X, Algorithm-Y, and Algorithm- Z), and that the number of coding rates is equal to the number of parameter sets which are set in the noise suppress section.

However, in practicing the present invention, the number of coding algorithm may not be equal to the number of noise suppress algorithm, and the number of coding algorithm may not be equal to the number of parameter sets which are set in the noise suppress section.

Besides, the number of coding rates may not be equal to the number of noise suppress algorithm, and the number of coding rates may not be equal to the number of parameter sets which are set in the noise suppress section.

Figure 10:
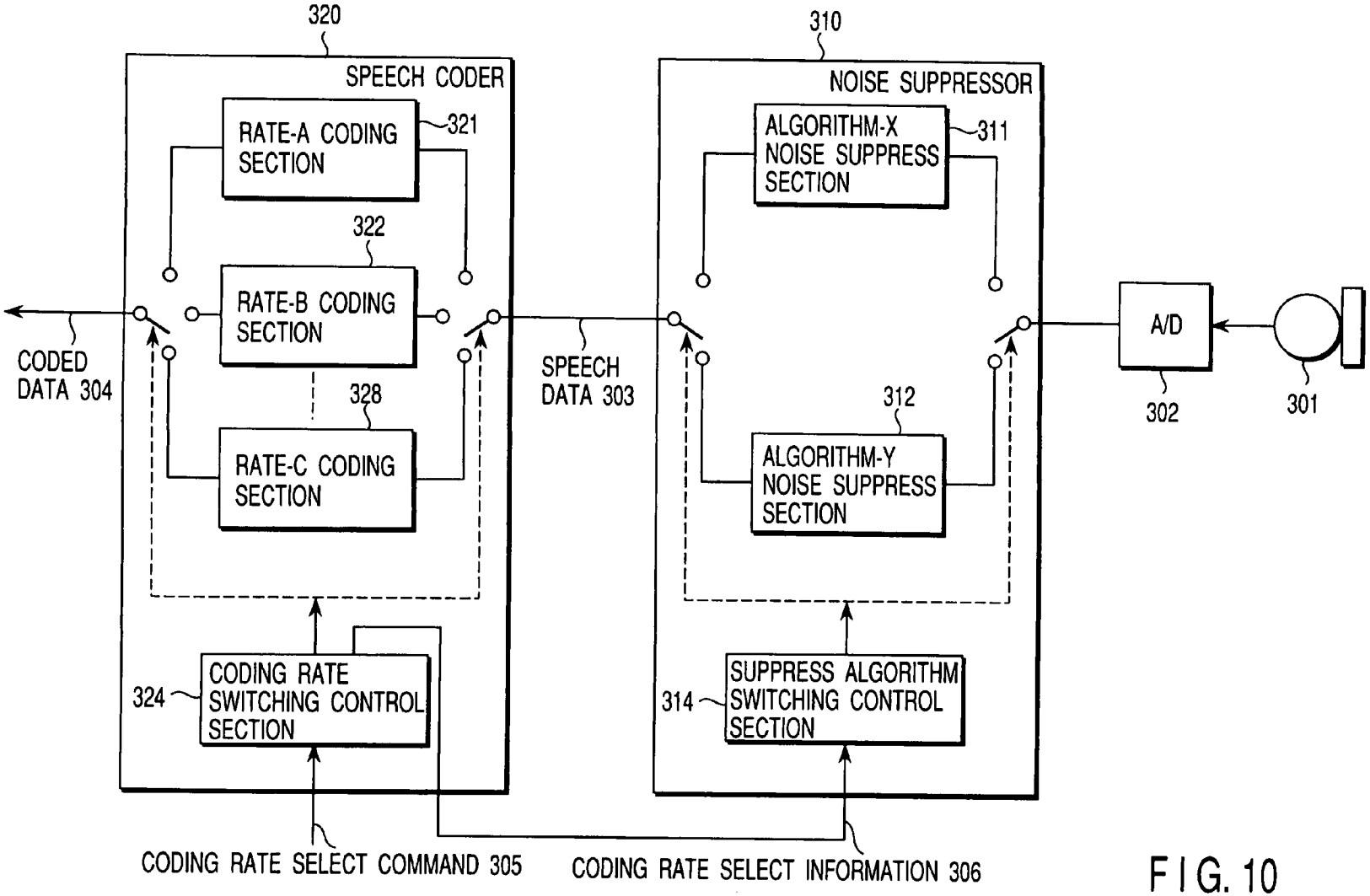
FIG. 10 is a section block diagram showing the structure of a modification of the third embodiment.

Referring to the third embodiment, as shown in FIG. 10, for example, eight coding sections (rate-A, rate-B, rate-C, . . . , rate-H) may be provided in the speech coder 320, and two noise suppress sections, i.e. an Algorithm-X noise suppress section and an Algorithm-Y noise suppress section, may be provided in the noise suppressor 310.

Figure 11:
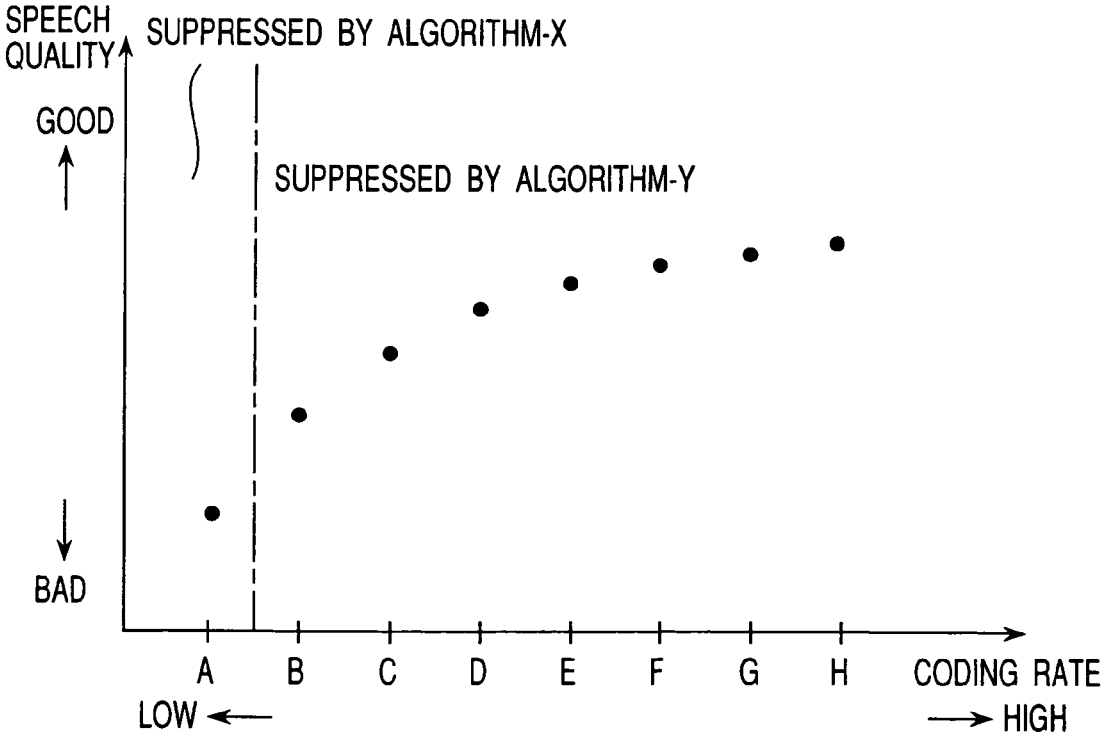
FIG. 11 is a graph showing a relationship between a coding process and a noise suppression process in a case where the number of kinds of coding processes is not equal to the number of kinds of noise suppression processes.

For example, as shown in FIG. 11, the Algorithm-X noise suppress section 311 may be used in association with the rate-A coding section 321 whose speech quality is not good, and the Algorithm-Y noise suppress section 312 may be used in association with the coding sections with the other coding rates.

Besides, the Algorithm-X noise suppression may be adopted for the rate-A, rate-B, rate-C and rate-D, and the Algorithm-Y noise suppression may be adopted for the rate-E, rate-F, rate-G and rate-H. Needless to say, in this way, various modifications are possible.

In short, it is important to associate in advance the coding rates with the noise suppression algorithm to be used in accordance with the coding rates (or the parameter sets to be set for noise suppression control in accordance with the coding rates). Thereby, various embodiments of the present invention can be realized.

As regards the first embodiment shown in FIG. 1, where the number of coding sections with different coding algorithm in the speech coder 120 is P (=a positive integer) and the number of noise suppress sections with different noise suppress algorithm in the noise suppressor 110 is Q (=a positive integer), it should suffice if the following relationship is established:

$$P \geqq Q > 1.$$

As regards the second embodiment shown in FIG. 3, where the number of coding sections with different coding algorithm in the speech coder 220 is P (=a positive integer) and the number of parameter sets to be set in the noise suppress section 215 of the noise suppressor 210 is S (=a positive integer), it should suffice if the following relationship is established:

$$P \geqq S > 1.$$

As regards the third embodiment shown in FIG. 5, where the number of coding sections with different coding rates in the speech coder 320 is R (=a positive integer) and the number of noise suppress sections with different noise suppress algorithm in the noise suppressor 310 is Q (=a positive integer), it should suffice if the following relationship is established:

$$R \geqq Q > 1.$$

As regards the fourth embodiment shown in FIG. 7, where the number of coding sections with different coding algorithm in the speech coder 420 is R (=a positive integer) and the number of parameter sets to be set in the noise suppress section 415 of the noise suppressor 410 is S (=a positive integer), it should suffice if the following relationship is established:

$$R \geqq S > 1.$$

Figure 12:
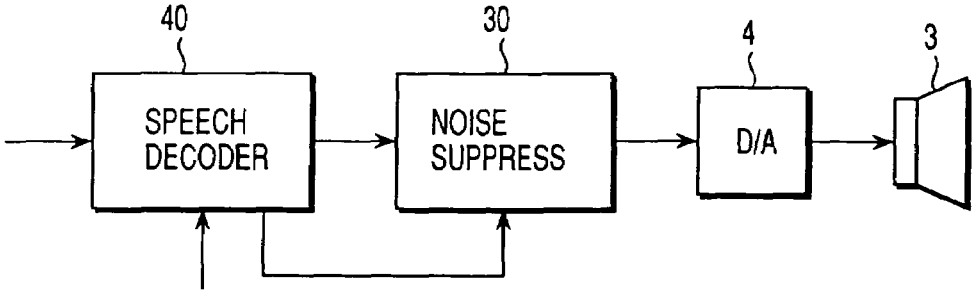
FIG. 12 shows a schematic structure of an output speech decoding section, to which the signal processing apparatus of the present invention is applied.

The present invention is applicable not only to the coding of speech to be transmitted, as described above, but also to decoding of coded speech data, as illustrated in FIG. 12.

In FIG. 12, reference numeral 3 denotes a loudspeaker, and 4 a D/A converter. Reference numeral 40 denotes a speech decoder for decoding speech data by selectively using a plurality of decoding algorithm or a plurality of coding rates. A noise suppressor 30 performs an optimal background noise suppression process in accordance with the decoding process of the speech decoder 40.

Where the present invention is applied to the decoding process, like the coding process, the structures according to the four embodiments can be adopted. Even where the decoding algorithm or coding rate is switched in these structures, the noise suppresser can function with high performance, and high-quality speech can be received.

The present invention can easily be applied to decoding systems by a person skilled in the art on the basis of the above descriptions and FIGS. 1 to 11, if the "coding" in the descriptions is read as "decoding" and the flow of signals as shown in FIG. 12 is adopted.

Figure 13:
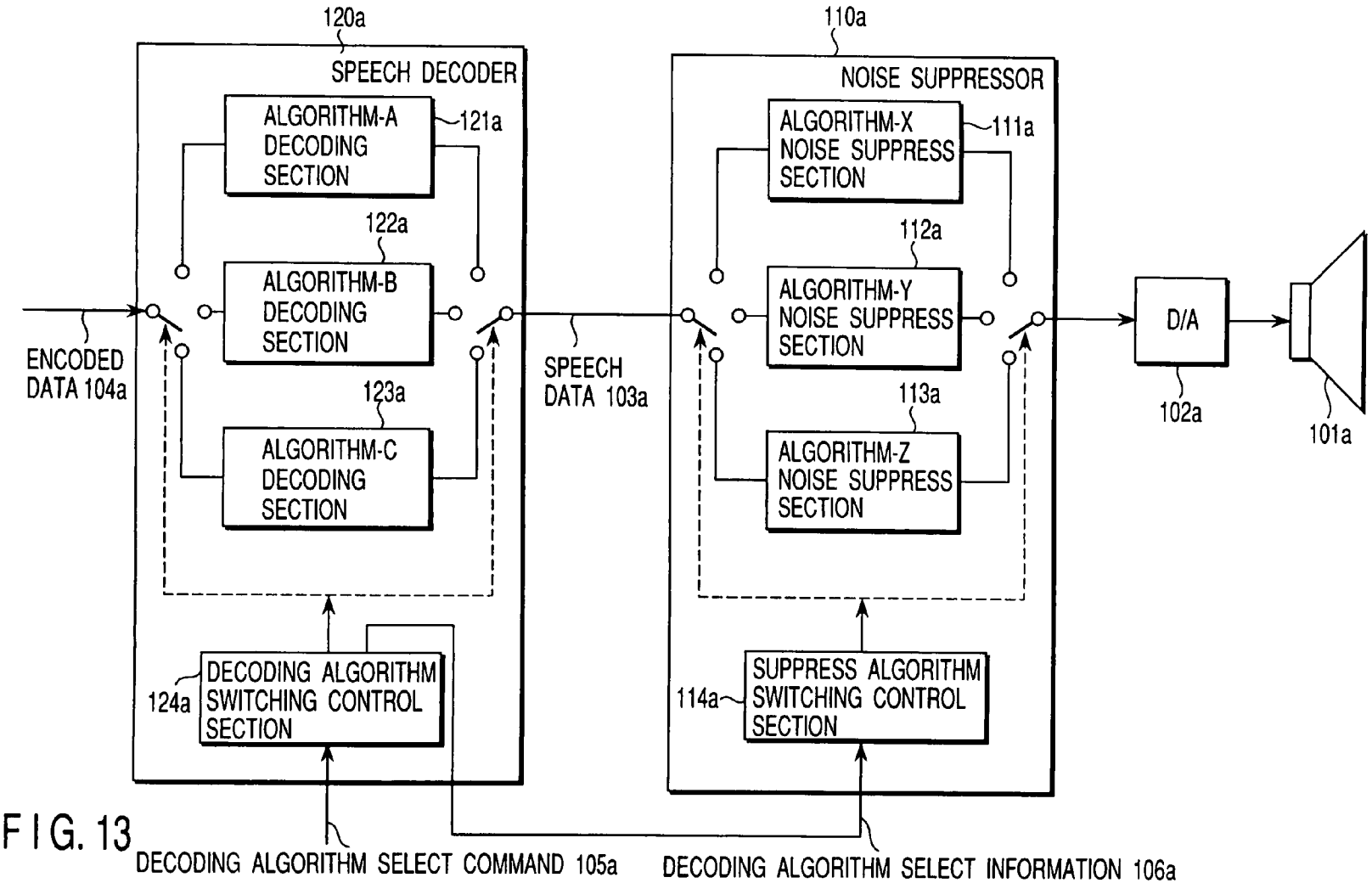
FIG. 13 shows an example of the structure wherein the invention is applied to the decoding systems.

A description will now be given of an example of the decoding as applied to the above-described first embodiment. FIG. 13 shows the structure in this example.

In FIG. 13, reference numeral 104*a* denotes compressed coded data; 120*a* a speech decoder for decompressing the decoded data 104*a* to speech data 103; 110*a* a noise suppressor for suppressing background noise contained in the speech data 103; 102*a* a D/A converter for converting the speech data, in which the background noise has been suppressed by the noise suppressor 110*a*, to an analog speech signal; and 101*a* a loudspeaker for outputting the analog speech signal.

The speech decoder 120*a* includes, as three sections for decoding coded speech data by different algorithm, an Algorithm-A decoding section 121*a*, an Algorithm-B decoding section 122*a* and an Algorithm-C decoding section 123*a*. In addition, the speech decoder 120*a* includes a decoding algorithm switching control section 124*a*.

For example, the Algorithm-A decoding section 121*a* performs a decoding process in which the decoding rate is low but the quality of decoded sound relative to background noise is not good. The Algorithm-C decoding section 123*a* performs a decoding process in which the decoding rate is high and the quality of decoded sound relative to background noise is relatively good. The Algorithm-B decoding section 122*a* performs a decoding process capable of obtaining an intermediate speech quality between the Algorithm-A decoding section 121*a* and the Algorithm-C decoding section 123*a*.

In response to an external decoding algorithm select command 105*a*, the decoding algorithm switching control section 124*a* effects switching among the Algorithm-A decoding section 121*a*, Algorithm-B decoding section 122*a* and Algorithm-C decoding section 123*a* so that one of them may function. In addition, the decoding algorithm switching control section 124*a* delivers information representative of the decoding algorithm chosen by the switching to the noise suppressor 110*a* as decoding algorithm select information 106*a*.

The noise suppressor 110*a* includes, as three sections for suppressing background noise by different algorithm, an Algorithm-X noise suppress section 111*a*, an Algorithm-Y noise suppress section 112*a* and an Algorithm-Z noise suppress section 113*a*. In addition, the noise suppressor 110*a* includes a suppress algorithm switching control section 114*a*.

In response to the decoding algorithm select information 106*a*, the suppress algorithm switching control section 114*a* effects switching among the Algorithm-X noise suppress section 111*a*, Algorithm-Y noise suppress section 112*a* and Algorithm-Z noise suppress section 113*a* so that an optimal one of them may function.

In the switching control by the suppress algorithm switching control section 114*a*, the optimal noise suppress section (111*a*, 112*a* or 113*a*) is made to function in association with the decoding section (121*a*, 122*a* or 123*a*) activated in the speech decoder 120*a*. Specifically, where the Algorithm-A decoding section 121*a* functions, the Algorithm-X noise suppress section 111*a* is selected by the decoding algorithm select information 106*a*. Where the Algorithm-B decoding section 122*a* functions, the Algorithm-Y noise suppress section 112*a* is selected by the decoding algorithm select information 106*a*. Where the Algorithm-C decoding section 123*a* functions, the Algorithm-Z noise suppress section 113*a* is selected by the decoding algorithm select information 106*a*.

In order to optimize the correspondency between the decoding section and the noise suppress section, the Algorithm-X noise suppress section 111*a*, for example, adopts a spectral subtraction (SS) method in a frequency domain with a high noise suppress performance, although somewhat complex processing needs to be performed. The Algorithm-Y noise suppress section 112*a* adopts a similar SS method, in which, however, less complex processing needs to be performed than in the Algorithm-X noise suppress section 111*a*. The Algorithm-Z noise suppress section 113*a* adopts an adaptive filtering method in a time domain with a relatively simple scheme.

Figure 14:
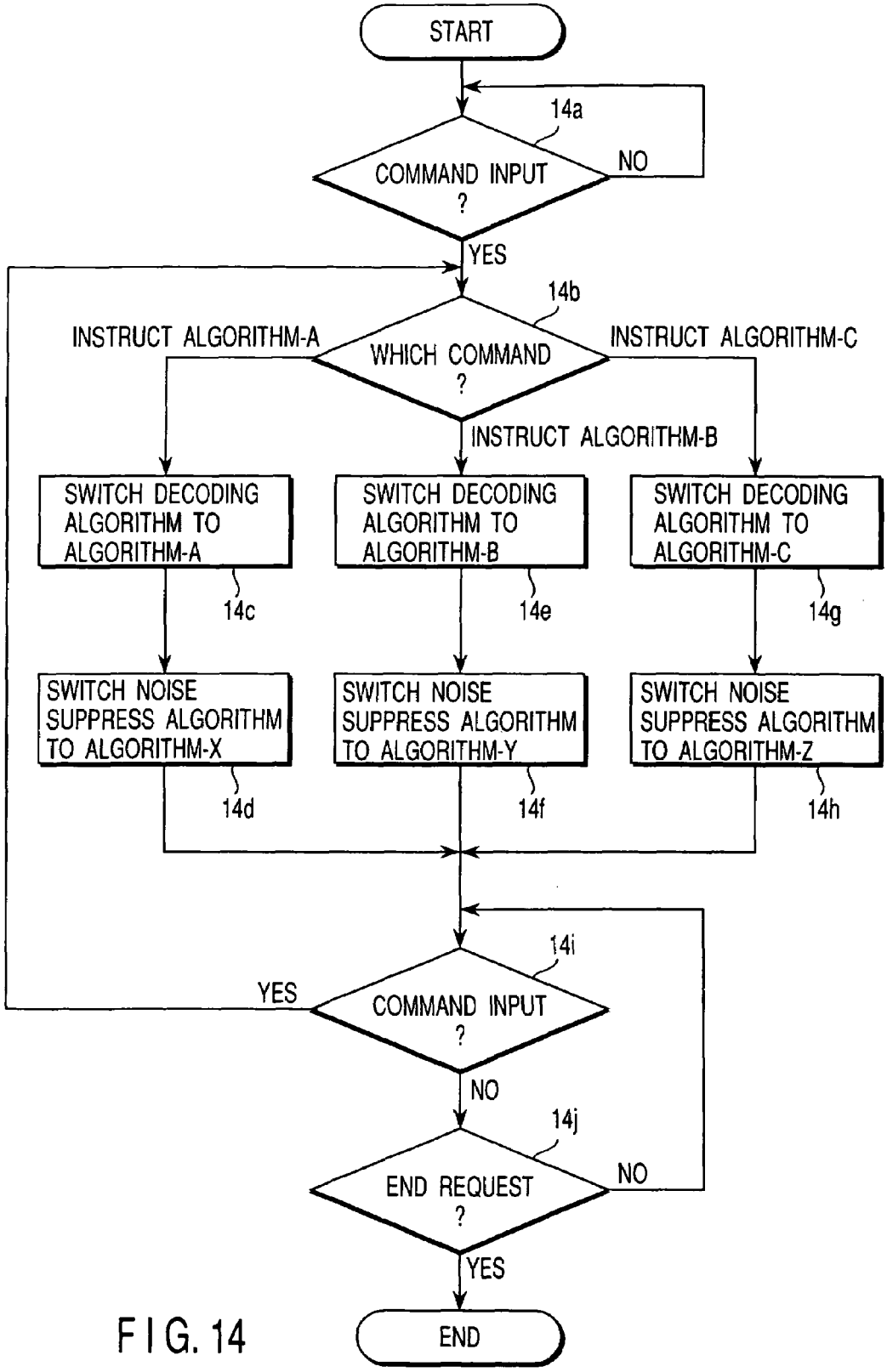
FIG. 14 is a flow chart illustrating the operation of the apparatus shown in FIG. 13.

The operation of the signal processing apparatus with the above structure will now be described. FIG. 14 is a flow chart illustrating this operation.

In a command input standby state in step 14*a*, if the decoding algorithm select command 105*a* to the effect that "Use the Algorithm-A as the decoding algorithm" has been input to the decoding algorithm switching control section 124*a*, control advances to step 14*b* to determine the designated decoding algorithm. Since the designated decoding algorithm is the Algorithm-A in this case, control goes to step 14*c*.

In step 14*c*, the decoding algorithm switching control section 124*a* controls switching so that the coded data 104*a* may be input to the Algorithm-A decoding section 121*a*. Accordingly, the Algorithm-A decoding section 121*a* begins decoding the input coded data 104*a*.

In step 14*c*, in parallel with the switching control, the decoding algorithm switching control section 124*a* outputs, as the decoding algorithm select information 106*a*, the information to the effect that the Algorithm-A decoding section 121*a* is to be used for decoding the coded data 104*a* to the suppress algorithm switching control section 114*a*. Control then goes to step 14*d*.

In step 14*d*, the suppress algorithm switching control section 114*a* controls switching so that the output from the speech decoder 120*a* may enter the Algorithm-X noise suppress section 111*a*, thereby effecting noise suppression by the Algorithm-X noise suppress section 111*a*, which is optimized for the decoding by the Algorithm-A decoding section 121*a*. Control then goes to step 14*i*.

With this switching control operation, the coded data 104*a* is decoded by the Algorithm-A decoding section 121*a* and subjected to noise suppression in the Algorithm-X noise suppress section 111*a*. The output from the Algorithm-X noise suppress section 111*a* is D/A converted by the D/A converter 102*a* and output from the loudspeaker 101*a*.

In step 14*i*, if the decoding algorithm select command 105*a* to the effect that "Use the Algorithm-B as the decoding algorithm" has been input to the decoding algorithm switching control section 124*a*, control advances to step 14*b* to determine the designated decoding algorithm. Since the designated decoding algorithm is the Algorithm-B in this case, control goes to step 14*e*.

In step 14*e*, the decoding algorithm switching control section 124*a* controls switching at a proper timing so that the coded data 104*a* may be input to the Algorithm-B decoding section 122*a*. Accordingly, the Algorithm-A decoding section 121*a* stops functioning, and instead the Algorithm-B decoding section 122*a* begins decoding the input coded data 104*a*.

In step 14*e*, in parallel with the switching control, the decoding algorithm switching control section 124*a* outputs, as the decoding algorithm select information 106*a*, the information to the effect that the Algorithm-B decoding section 122*a* is to be used for decoding the coded data 104*a* to the suppress algorithm switching control section 114*a*. Control then goes to step 14*f*.

In step 14*f*, the suppress algorithm switching control section 114*a* controls switching so that the speech data 103*a* from the speech decoder 120*a* may enter the Algorithm-Y noise suppress section 112*a*, thereby effecting noise suppression by the Algorithm-Y noise suppress section 112*a*, which is optimized for the decoding by the Algorithm-B decoding section 122*a*. Control then goes to step 14*i*.

With this switching control operation, the coded data 104*a* is decoded by the Algorithm-B decoding section 122*a* and subjected to noise suppression in the Algorithm-Y noise suppress section 112*a*. The output from the Algorithm-Y noise suppress section 112 is D/A converted by the D/A converter 102*a* and output from the loudspeaker 101*a*.

In step 14*i*, if the decoding algorithm select command 105*a* to the effect that "Use the Algorithm-C as the decoding algorithm" has been input to the decoding algorithm switching control section 124*a* while the coded data 104*a* is being coded in the Algorithm-A decoding section 121*a* or Algorithm-B decoding section 122*a* as described above, control advances to step 14*b* to determine the designated decoding algorithm. Since the designated decoding algorithm is the Algorithm-C in this case, control goes to step 14*g*.

In step 14*g*, the decoding algorithm switching control section 124*a* controls switching at a proper timing so that the coded data 104*a* may be input to the Algorithm-C decoding section 123*a*. Accordingly, the Algorithm-A decoding section 121*a* or Algorithm-B decoding section 122*a* stops functioning, and instead the Algorithm-C decoding section 123*a* begins decoding the input coded data 104*a*.

In step 14*g*, in parallel with the switching control, the decoding algorithm switching control section 124*a* outputs, as the decoding algorithm select information 106*a*, the information to the effect that the Algorithm-C decoding section 123*a* is to be used for decoding the coded data 104*a* to the suppress algorithm switching control section 114*a*. Control then goes to step 14*h*.

In step 14*h*, the suppress algorithm switching control section 114*a* controls switching so that the speech data 103*a* from the speech decoder 120*a* may enter the Algorithm-Z noise suppress section 113*a*, thereby effecting noise suppression by the Algorithm-Z noise suppress section 113*a*, which is optimized for the decoding by the Algorithm-C decoding section 123*a*. Control then goes to step 14*i*.

With this switching control operation, the coded data 104*a* is decoded by the Algorithm-C decoding section 123*a* and subjected to noise suppression in the Algorithm-Z noise suppress section 113*a*. The output from the Algorithm-Z noise suppress section 113*a* is D/A converted by the D/A converter 102*a* and output from the loudspeaker 101*a*.

In step 14*i*, if no command is input, control goes to step 14*j*. In step 14*j*, it is determined whether a communication end request is input. If the communication end request has been input, the present process is finished. If the communication end request is not input, command input is monitored once again in step 14*i*.

As has been described above, in the signal processing apparatus having the above structure, when speech is to be output from the loudspeaker, the optimal noise suppress section (111*a*, 112*a* or 113*a*) is activated in accordance with the decoding section (121*a*, 122*a* or 123*a*) functioning in the speech decoder 120*a*.

According to the signal processing apparatus with the above structure, noise suppression is effected by the optimal noise suppress section for the decoding by the speech decoder 120*a*. Thus, the noise suppress section functions with high performance, and high-quality speech can be output from the loudspeaker.

In the meantime, in the third and fourth embodiments, the three sections are selectively used in the speech coder 320 (420) with the variable coding rate, as shown in FIG. 5 and FIG. 7.

However, the present invention is not limited to this structure. As is shown in FIG. 15, parameters in one coding section 725 provided in a speech coder 720 may be varied so that the coding rate may be altered.

Figure 15:
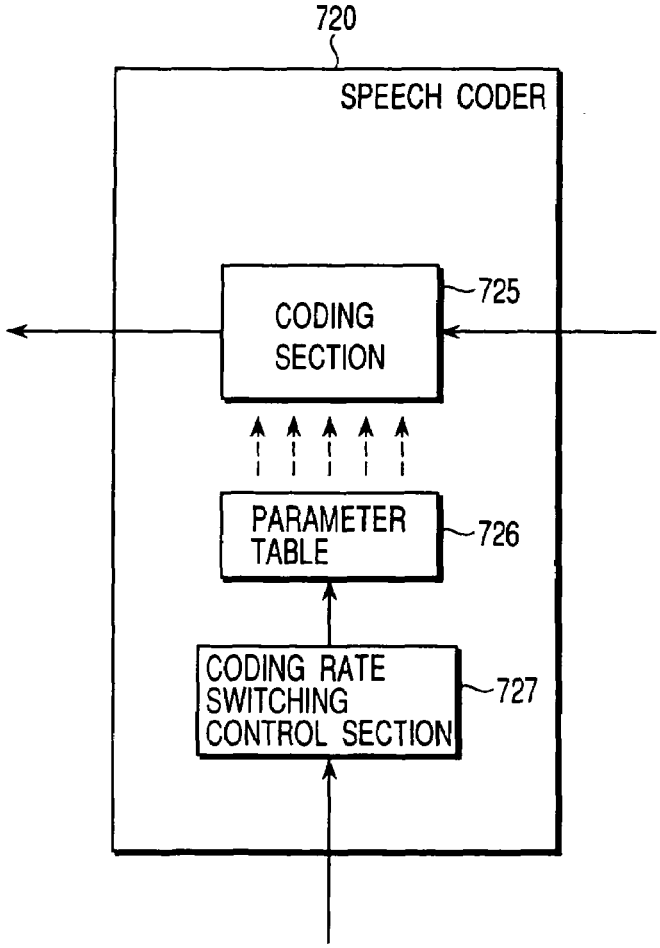
FIG. 15 is a section block diagram showing the structure of a modification of the speech coder in the signal processing apparatuses shown in FIGS. 1–7.

In the structure shown in FIG. 15, parameter sets for coding with plural coding rates are stored in a parameter table 726 in advance. Responding to a request from the outside, a coding rate switching control section 727 causes the parameter table 726 to output an optimal parameter set to the coding section 725.

Even where the speech coder 720 with this structure is used, the noise suppress section can function with high performance, and high-quality speech can be received, as in the third and fourth embodiments.

It is possible to substitute the speech coder 720, as shown in FIG. 15, for any one of the coding sections 121 to 123 (221 to 223) of the speech coder 120 (220) in FIGS. 1 and 3.

It is also possible to apply the structure of FIG. 15 to the decoding-side structure shown in FIG. 12, although there is a difference between the coding process and the decoding process. Even where the decoding algorithm or coding rate is switched in this case, the noise suppresser can function with high performance, and high-quality speech can be received.

In the fourth embodiment, the structure of the noise suppressor 410 may be modified such that when specific coding rate information has been detected, noise suppression is turned off (i.e. noise suppression is not effected) in all frequency bands or a part of frequency bands.

Figure 16:
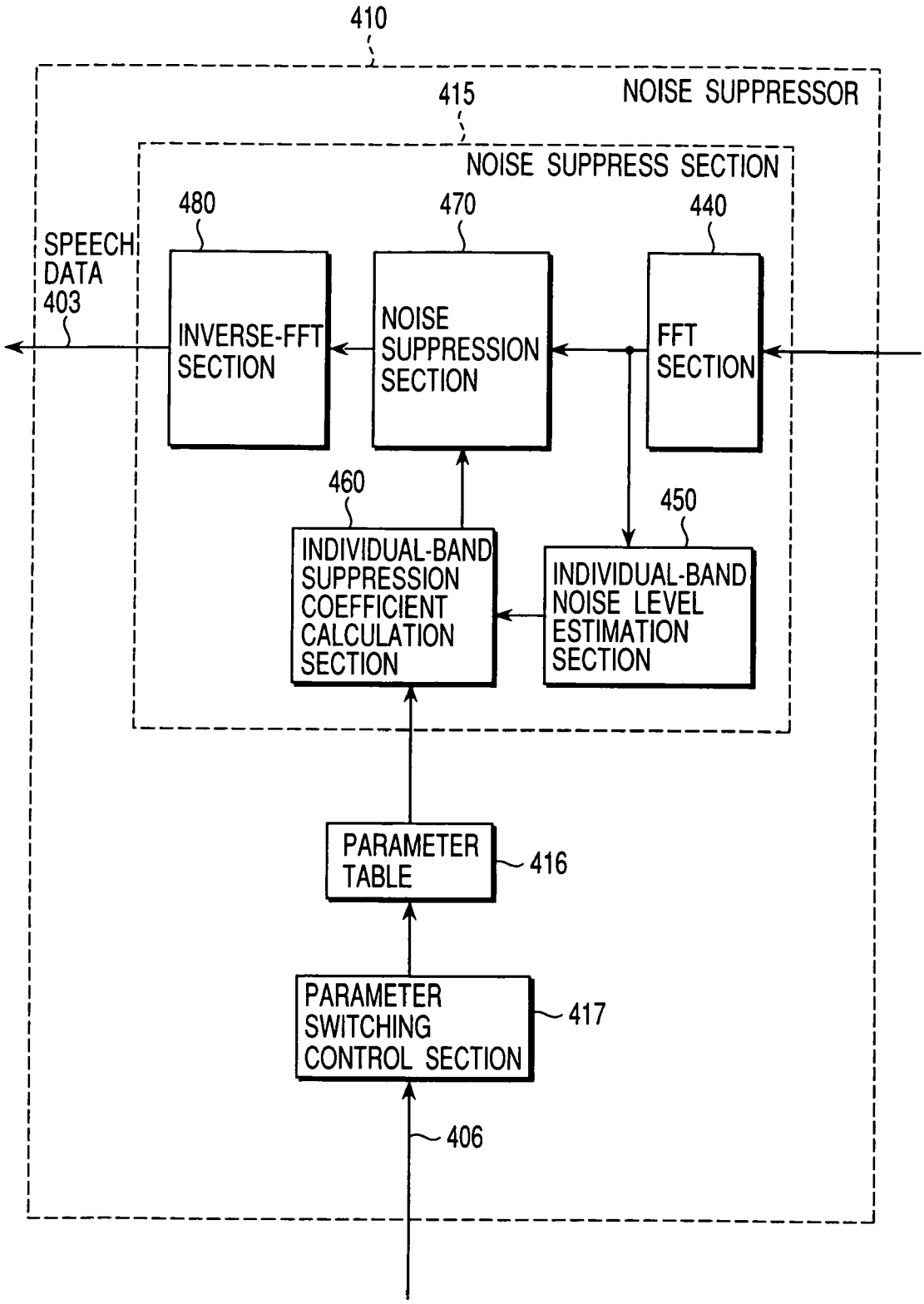
FIG. 16 is a section block diagram showing the structure of a modification of the noise suppressor in the signal processing apparatuses shown in FIGS. 1–7.

FIG. 16 shows an example in which the structure for performing such noise suppression is applied to the noise suppressor 410. A detailed description will now be given with reference to FIG. 16.

In this example, noise suppression is carried out by a spectral subtraction (SS) method, with a speech signal being divided into M frequency bands. The value of M is normally 6 to 32, although varying depending on the noise suppression algorithm.

The parameter switching control section 417 detects the coding rate used in the speech coder 420, on the basis of the coding rate select information 406. The parameter switching control section 417 causes the parameter table 416 to deliver the parameter set corresponding to the detected coding rate to an individual-band suppression coefficient calculation section 460 in the noise suppress section 415.

In this case, the parameter set input from the parameter table 416 to the individual-band suppression coefficient calculation section 460 consists of L control parameters. Where noise suppression is controlled at a substantially equal level in all frequency bands, one control parameter (L=1) is output in association with one coding rate.

On the other hand, where noise suppression is controlled at different levels in M frequency bands, M control parameters (L=M) are generated in association with one coding rate. The value of L, however, is not limited to M.

For the purpose of easier description, assume that three coding rates A, B and C are adopted, and L=M. Control parameters associated with the coding rate A can be represented by C(A,0), C(A,1), . . . , C(A,M−1).

Symbol C(A,k), for instance, denotes a control parameter associated with the coding rate A and used for controlling a k-th band of M divided frequency bands. FIG. 17 is a table showing the relationship between the coding rates (bit rates) and the divided bands.

As has already been described in connection with the fourth embodiment, the noise suppress section 415 subjects the input signal to noise suppression according to the control parameter delivered from the parameter table 416. The noise suppress section 415 comprises an FFT section 440, an individual-band noise level estimation section 450, an individual-band suppression coefficient calculation section 460, a noise suppression section 470 and an inverse FFT section 480.

The FFT section 440 converts the input speech signal from a dime domain to a frequency domain by FFT (Fast Fourier Transform). Other methods for conversion to a frequency domain, DCT or other transforms, may also be used.

The individual-band noise level estimation section 450 divides the speech signal, which has been converted to the frequency domain, into a predetermined number (M) of bands, and estimates noise levels in the speech signal in individual bands. The individual-band suppression coefficient calculation section 460 calculates noise suppression coefficients of individual bands on the basis of the individual-band noise levels estimated by the individual-band noise level estimation section 450.

Assume that the individual-band noise suppression coefficients are D(0), D(1), . . . , D(M−1). Symbol D(k) denotes a noise suppression coefficient used for controlling a k-th band of M divided frequency bands.

In the present invention, the noise suppressing process is controlled using not only the noise suppression coefficients obtained only by the analysis of the input signal, but also control parameters obtained based on the coding rate information. In one method for realizing this, a control parameter is set such that a value obtained by multiplying the control parameter by a noise suppression coefficient can be used as a new noise suppression coefficient.

For example, the noise suppression coefficient D(k) is modified using the control parameter C(k) obtained from the coding rate information, according to the operation shown below. The modified noise suppression coefficient D(k) is output to the noise suppression section 470.

$$D(k) \leftarrow D(k) \times C(k)(k=0, \ldots, M-1)$$

The noise suppression section 470 multiplies the frequency-dimension speech spectrum obtained from the input speech signal by 1−D(k) in each band, using the modified suppression coefficient obtained by the individual-band suppression coefficient calculation section 460. Thus, the noise suppression section 470 produces a noise-suppressed speech spectrum. The inverse FFT section 480 transforms the speech spectrum produced by the noise suppression section 470 to a time-dimension speech signal.

For example, when noise suppression is to be turned off (i.e. noise suppression is not to be effected) in all frequency bands at the time of the coding rate C which is a highest coding rate, all the individual-band control parameters used when the bit rate C is detected are set at "0", as shown in FIG. 18.

When noise suppression is to be turned off (i.e. noise suppression is not to be effected) in the frequency band M−1 alone at the time of the coding rate B, the control parameter used when the bit rate B is detected is set at "0", as shown in FIG. 19.

According to the above-described structure, needless to say, other various settings are possible.

As has been described above, the noise suppression process to be carried out by the noise suppress section 415 is controlled using the control parameters generated from the coding rate information. Thus, the variable-rate speech processing apparatus, in which the whole balance between the noise suppression and variable-rate speech coding is more considered than in the prior art, can be realized.

As is well known, the prior-art noise suppression process is unable to completely eliminate noise alone from an input speech signal. If an attempt is made to completely eliminate the noise, part of the speech signal would be removed along with the noise. As a result, some sound would be omitted, or a sound different from background noise would come in. Consequently, noise-suppressed speech would lose naturalness and deteriorate.

It is also known that degradation in speech quality due to coding is generally small when a clear sound signal with least noise is coded, because an analysis for coding is successfully performed and such a clear speech signal conforms to a coding algorithm.

On the other hand, if a speech signal with much background noise is coded, in particular, with a low coding rate, coding of non-speech components would greatly deteriorate. Thus, a higher speech quality is obtained if a speech signal, from which background noise has been removed to some extent, is coded.

In the case of speech coding at a high coding rate, the performance of coding itself is high even if speech to be coded contains a relatively high level background noise. Accordingly, deterioration in speech quality due to background noise is small, and a speech quality close to a natural one is obtained.

In the case of speech coding at a low coding rate, noise suppression to some degree may possibly provide a good speech quality as a whole. However, in the case of speech coding at a high coding rate, noise suppression is not always needed in an application requiring a speech quality with high naturalness.

An effective method in this case is one as explained with reference to FIG. 18, wherein all the control parameters in individual bands at a specific coding rate (or coding rates) are set at "0" and thus noise suppression is turned off (i.e. noise suppression is not effected) in all frequency bands.

If the noise suppressor 410 as shown in FIG. 16 is used for this purpose, the noise suppression function can be controlled according to the coding rate more flexibly than in the prior art. Thus, the speech quality can be improved when the variable-rate speech processing apparatus is used in an environment in which much background noise may come in.

In the present example, the structure shown in FIG. 16 is applied to the noise suppressor 410 as shown in FIG. 7 in which the coding rate is varied on the coding side. However, it can also be applied to a noise suppressor which suppresses noise according to the coding rate on the decoding side, or to a noise suppressor which suppresses noise according to the coding algorithm or decoding algorithm. In these cases, too, the same advantages can be obtained, needless to say.

Figure 20:
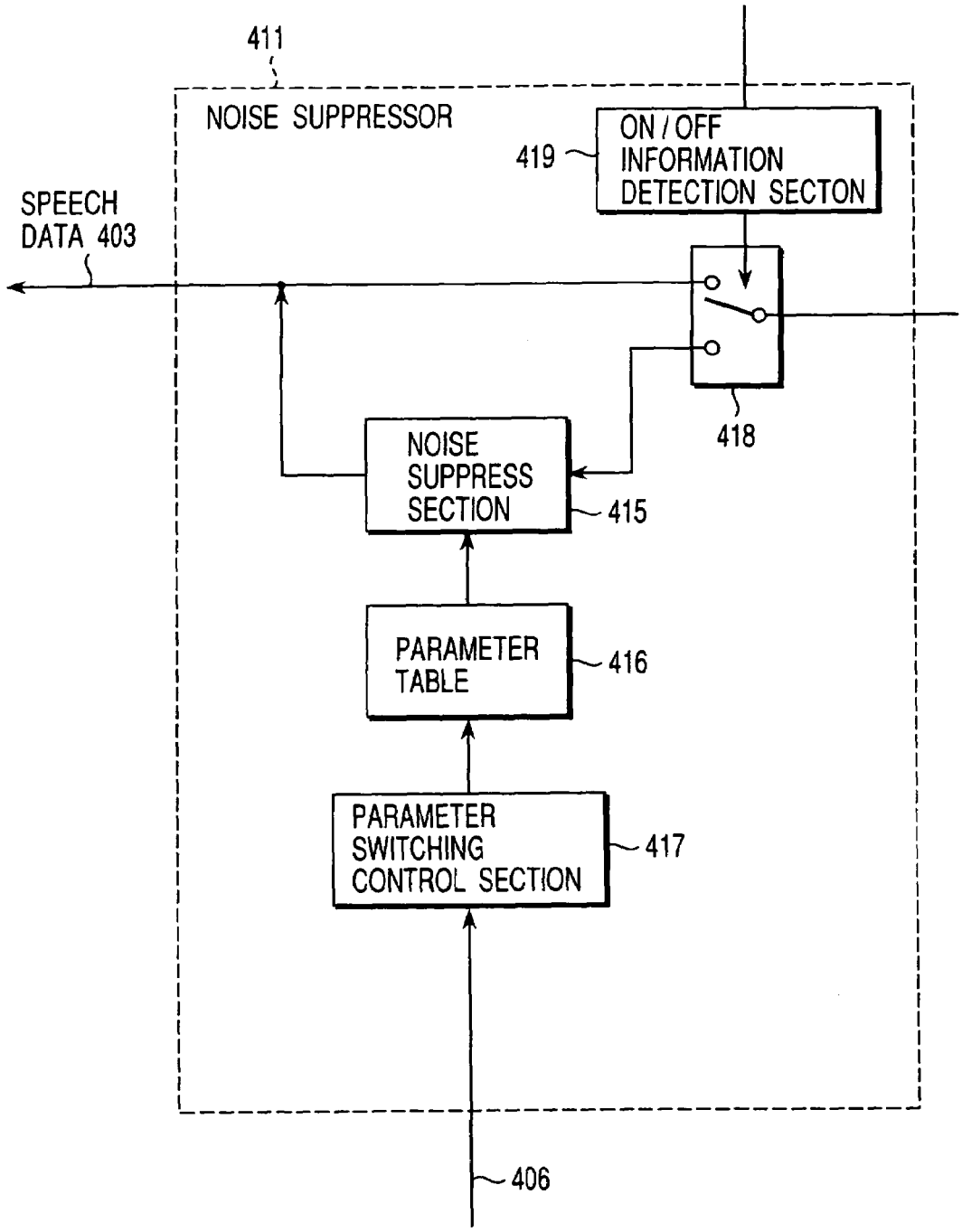
FIG. 20 is a section block diagram showing the structure of a modification of the noise suppressor in the signal processing apparatuses shown in FIGS. 1–7.

In the fourth embodiment, the noise suppressor 410 may be replaced with a noise suppressor 411 having a structure as shown in FIG. 20. With this structure, noise suppression is forcibly turned off (i.e. noise suppression is not effected) according to a request from the outside, irrespective of the coding rate.

In FIG. 20, the noise suppress section 415, parameter table 416 and parameter switching control section 417 are common with the structure of the fourth embodiment, and a description thereof is omitted. A description will now be given of newly provided elements: an ON/OFF information detection section 419 and a change-over switch 418.

The ON/OFF information detection section 419 detects/determines information from the outside which instructs an ON/OFF control of a function for suppressing noise, and operates the change-over switch 418 according to the determination result.

Specifically, when the instruction for turning on the function for suppressing noise has been detected, the switch 418 is operated to deliver the speech data from the A/D converter 402 to the noise suppress section 415. On the other hand, when the instruction for turning off the function for suppressing noise has been detected, the switch 418 is operated to deliver the speech data from the A/D converter 402 to the speech coder 420 at the rear stage as digital data 403, without intervention of the noise suppress section 415.

In an example of the external control for turning on/off the noise suppression function, the noise suppressor 411 may be on/off controlled from a communication network. In a communication path, a so-called tandem-connection may occur in which coding/decoding is performed twice between the receiving side and the transmission side. A reason why the external control is needed is that it is necessary to prevent the tandem-connection from occurring when noise suppression is performed twice.

The essence of the control for preventing the tandem-connection resides not in the turning on (activation) of noise suppression, but in the turning off (inactivation) of noise suppression. Taking this into account, when the noise suppression function is on/off controlled from the outside, e.g. from the communication network, control operations may be combined on the basis of intentions of both the transmission and receiving sides.

In the present example, the structure of the noise suppressor 411 shown in FIG. 20 is applied to the noise suppressor 410 shown in FIG. 7 in which the coding rate is varied on the coding side. However, this structure may be applied to a noise suppressor for suppressing noise according to the coding rate on the decoding side, or to a noise suppressor for suppressing noise according to the coding algorithm or decoding algorithm. In these cases, too, the same advantages can be obtained, needless to say.

Figure 21:
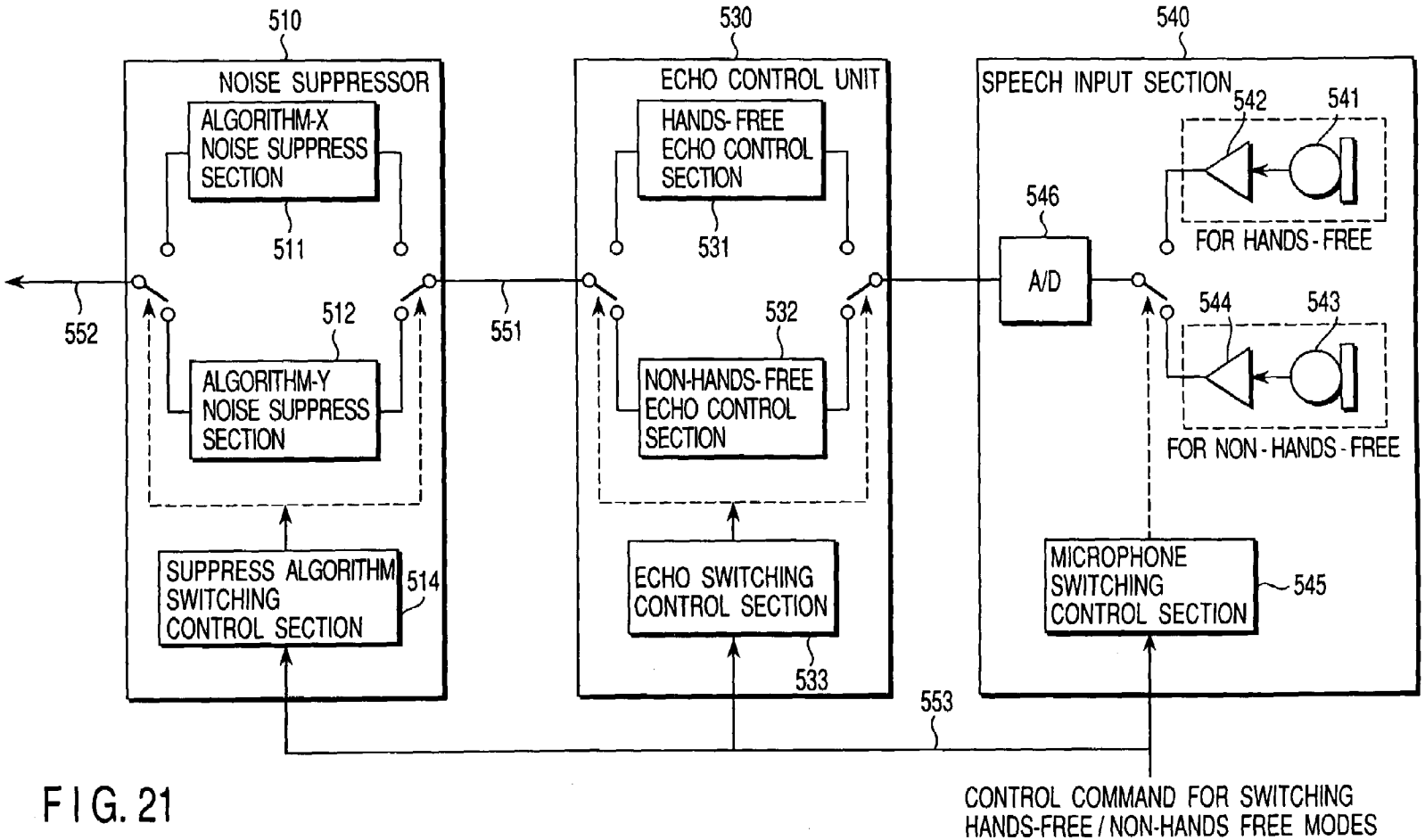
FIG. 21 is a section block diagram showing the structure of a signal processing apparatus according to a fifth embodiment of the present invention.

A signal processing apparatus according to a fifth embodiment of the present invention will now be described. FIG. 21 shows the structure of this apparatus.

A speech input section 540 functions to capture a user's speech to be transmitted, convert it to an electric signal, and digitize the signal to produce speech data. The speech input section 540 comprises a microphone 541 for a hands-free operation, a microphone amplifier 542 for a hands-free operation, a microphone 543 for a non-hands-free operation, a microphone amplifier 544 for a non-hands-free operation, a microphone switching control section 545, and an A/D converter 546.

The microphone switching control section 545 controls switching between the hands-free analog system and the non-hands-free analog system in accordance with a control command 553 for switching the hands-free/non-hands-free operations.

The A/D converter 546 receives an analog speech signal from the analog system selected by the switching control of the microphone switching control section 545, and digitizes the analog speech signal to produce speech data.

In the non-hands-free operation, the direction of arrival of speech and the distance of travel of speech are substantially invariable. Thus, a microphone having sensitivity and directivity meeting this condition is used. On the other hand, in the hands-free operation, a microphone needs to have a higher sensitivity so that speech from afar may be captured. In addition, since the direction of arrival speech is variable, the directivity of the microphone needs to be increased. Thus, the characteristics of the analog speech signal delivered to the A/D converter 546 are different between the hands-free operation and the non-hands-free operation.

An echo control unit 530 comprises a hands-free echo control section 531, a non-hands-free echo control section 532, and an echo switching control section 533.

The hands-free echo control section 531 is suitable when the hands-free microphone 541 and hands-free microphone amplifier 542 are used. The hands-free echo control section 531 reduces echo superimposed on the speech data output from the A/D converter 546.

On the other hand, the non-hands-free echo control section 532 is suitable when the non-hands-free microphone 543 and non-hands-free microphone amplifier 544 are used. The non-hands-free echo control section 532 reduces echo superimposed on the speech data output from the A/D converter 546. However, where echo suppression is not needed, the speech data is directly output without echo control.

The echo switching control section 533 controls switching between the hands-free echo control section 531 and non-hands-free echo control section 532 in accordance with the control command 553 for switching the hands-free/non-hands-free operations, so that the selected one of the echo control sections 531 and 532 may receive the speech data from the A/D converter 546.

With this control, speech data 551, which has been echo-reduced by the hands-free echo control section 531 or non-hands-free echo control section 532, is output to a noise suppressor 510.

The noise suppressor 510 includes, as two sections for suppressing background noise by different algorithm, an Algorithm-X noise suppress section 511 and an Algorithm-Y noise suppress section 512. In addition, the noise suppressor 510 includes a suppress algorithm switching control section 514.

The Algorithm-X noise suppress section 511 is designed to suitably suppress noise in the speech data 551 which is generated through the hands-free microphone 541, hands-free microphone amplifier 542 and hands-free echo control section 531, which are used in the hands-free operation.

On the other hands, the Algorithm-Y noise suppress section 512 is designed to suitably suppress noise in the speech data 551 which is generated through the non-hands-free microphone 543, non-hands-free microphone amplifier 544 and non-hands-free echo control section 532, which are used in the non-hands-free operation.

The suppress algorithm switching control section 514 controls switching between the Algorithm-X noise suppress section 511 and Algorithm-Y noise suppress section 512 in accordance with the control command 553 for switching the hands-free/non-hands-free operations, so that the optimal one of noise suppress sections 511 and 512 may receive the speech data 551.

Figure 22:
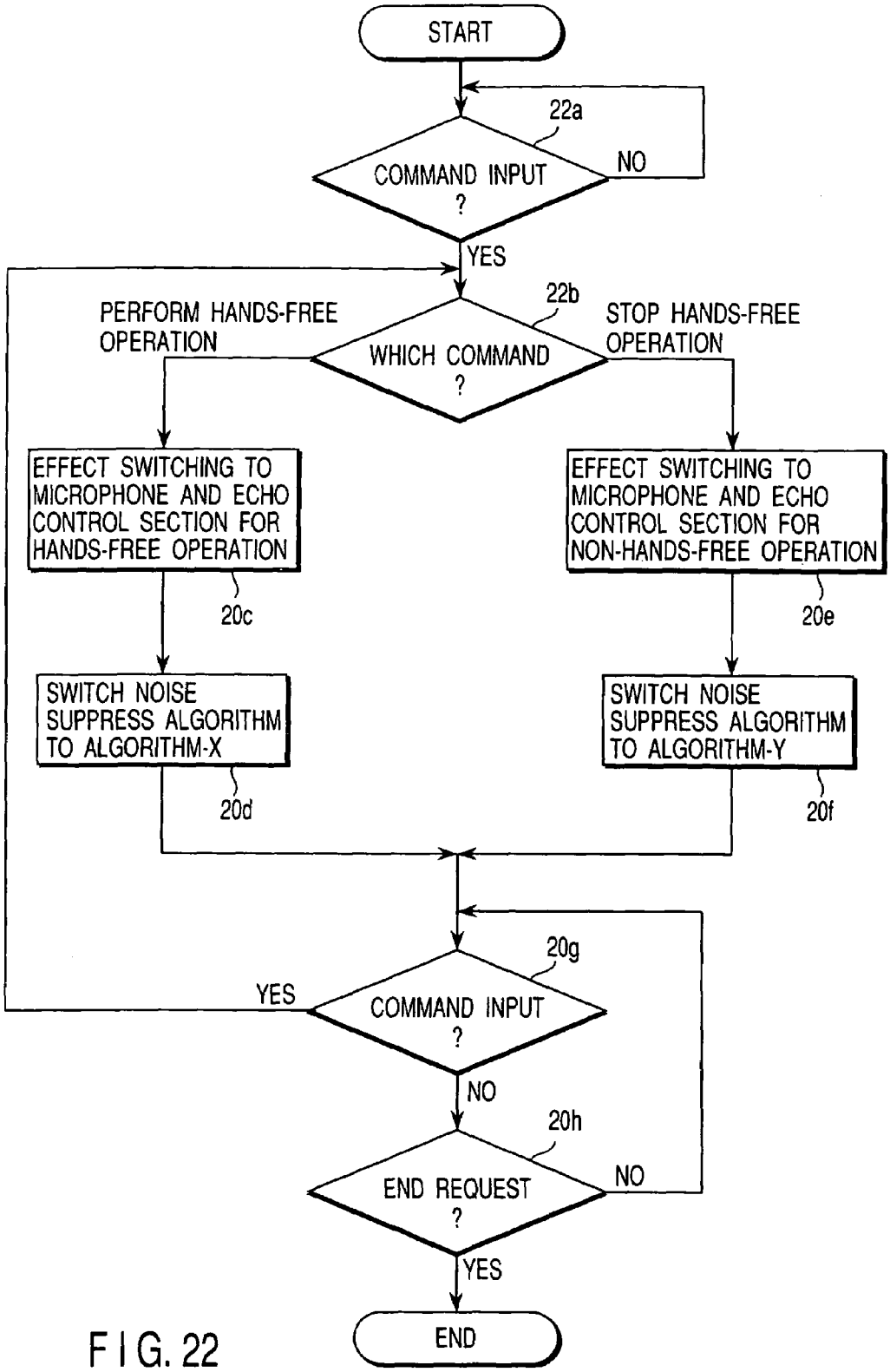
FIG. 22 is a flow chart illustrating the operation of the signal processing apparatus according to the fifth embodiment shown in FIG. 21.

The operation of the signal processing apparatus according to the fifth embodiment will now be described. FIG. 22 is a flow chart illustrating this operation.

In a command input standby state in step 22*a*, if the control command 553 to the effect that "Perform hands-free operation" has been input, control advances to step 22*b* to determine the content of the input command. Since the input command relates to the start of the hands-off operation, control goes to step 22*c*.

In step 22*c*, the microphone switching control section 545 begins a switching control so that the analog speech signal coming from the hands-free microphone 541 and hands-free microphone amplifier 542 may be input to the A/D converter 546.

In step 22*c*, in parallel with the switching control, the echo switching control section 533 effects switching according to the control command 553 so that the speech data from the A/D converter 546 may be input to the hands-free echo control section 531. Control then goes to step 22*d*.

In step 22*d*, according to the control command 553, the suppress algorithm switching control section 514 controls switching so that the speech data from the hands-free echo control section 531 may enter the Algorithm-X noise suppress section 511. Control then goes to step 22*g*.

Accordingly, where the hands-free operation command is input, the above switching control is effected and the user's speech input from the hands-free microphone 541 is subjected in the hands-free echo control section 531 to the echo control suitable for the case where the hands-free microphone 541 and hands-free microphone amplifier 542 are used.

The echo-controlled speech data 551 is subjected in the Algorithm-X noise suppress section 511 to the noise suppression process optimal for the case where the hands-free microphone 541, hands-free microphone amplifier 542 and hands-free echo control section 531 are used. The resultant data is output to the transmission section at the rear stage as transmission speech data 552.

In step 22*g*, if the control command 553 to the effect that "Stop the hands-free operation" is input, control goes to step 22*b* to determine the content of the input command. Since the input command relates to the stop of the hands-free operation, control goes to step 22*e*.

In step 22*e*, the microphone switching control section 545 begins a switching control so that the analog speech signal coming from the non-hands-free microphone 543 and non-hands-free microphone amplifier 544 may be input to the A/D converter 546.

In step 22*e*, in parallel with the switching control, the echo switching control section 533 effects switching according to the control command 553 so that the speech data from the A/D converter 546 may be input to the non-hands-free echo control section 532. Control then goes to step 22*f*.

In step 22*f*, according to the control command 553, the suppress algorithm switching control section 514 controls switching so that the speech data from the non-hands-free echo control section 532 may enter the Algorithm-Y noise suppress section 512. Control then goes to step 22*g*.

Accordingly, where the command for stopping the hands-free operation is input, the above switching control is effected and the user's speech input from the non-hands-free microphone 543 is subjected in the non-hands-free echo control section 532 to the echo control suitable for the case where the non-hands-free microphone 543 and non-hands-free microphone amplifier 544 are used.

The echo-controlled speech data 551 is subjected in the Algorithm-Y noise suppress section 512 to the noise suppression process optimal for the case where the non-hands-free microphone 543, non-hands-free microphone amplifier 544 and non-hands-free echo control section 532 are used. The resultant data is output to the transmission section at the rear stage as transmission speech data 552.

In step 22*g*, if no command is input, control goes to step 22*h*. In step 22*h*, it is determined whether a communication end request is input. If the communication end request has been input, the present process is finished. If the communication end request is not input, command input is monitored once again in step 22*g*.

As has been described above, in the signal processing apparatus having the above structure, when the echo-controlled, noise-suppressed transmission speech data 552 is to be acquired, the optimal noise suppress section (511 or 512) is activated in accordance with the hands-free/non-hands-free speech data generation path.

According to the signal processing apparatus with the above structure, noise suppression is effected by the noise suppress section suitable for the speech data generation path, i.e. speech data characteristics, even if the hands-free operation and non-hands-free operation are switched. Thus, the noise suppress section functions with high performance, and high-quality speech can be transmitted.

Figure 23:
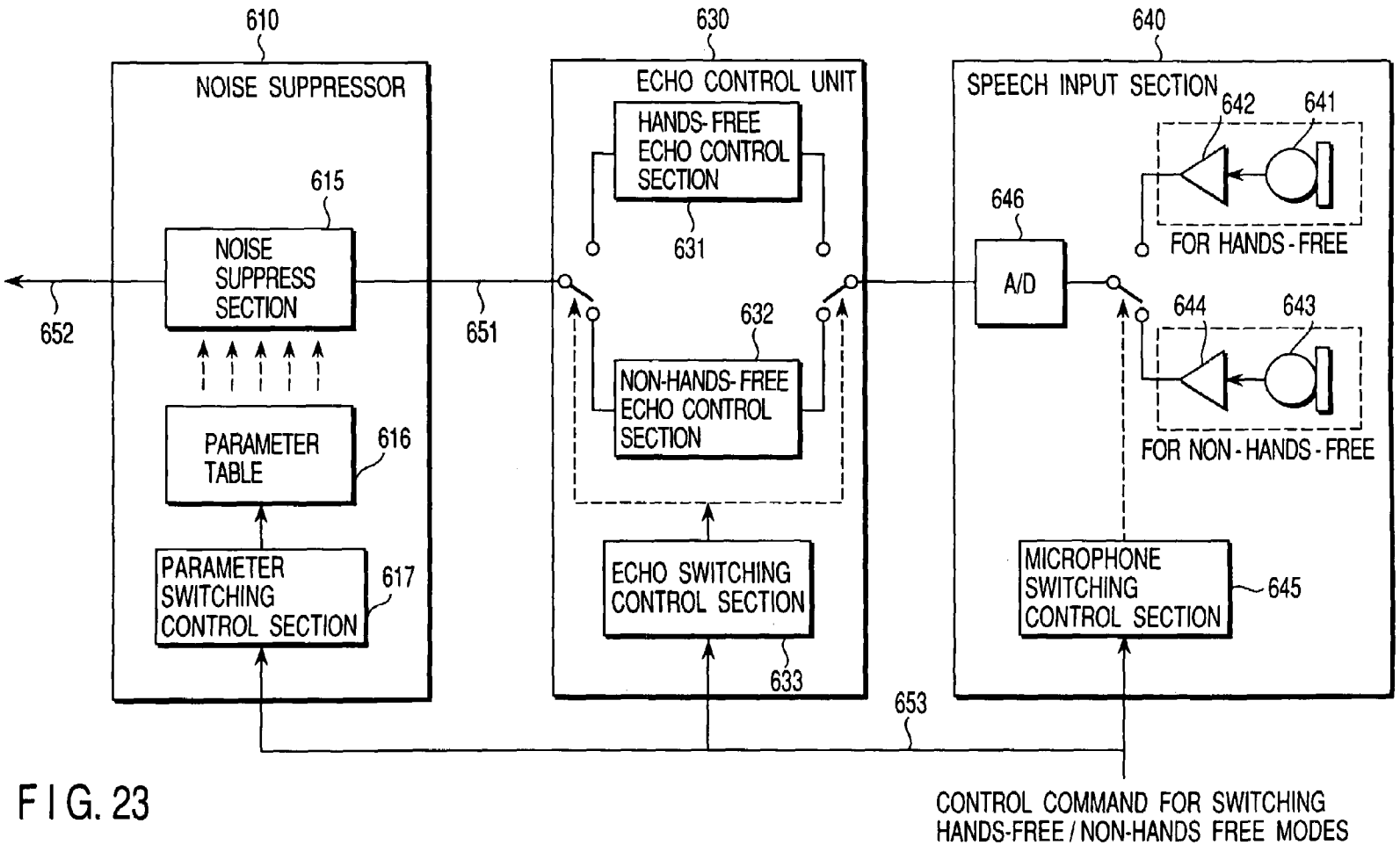
FIG. 23 is a section block diagram showing the structure of a signal processing apparatus according to a sixth embodiment of the present invention.

A signal processing apparatus according to a sixth embodiment of the present invention will now be described. FIG. 23 shows the structure of this apparatus.

A speech input section 640 functions to capture a user's speech to be transmitted, convert it to an electric signal, and digitize the signal to produce speech data. The speech input section 640 comprises a microphone 641 for a hands-free operation, a microphone amplifier 642 for a hands-free operation, a microphone 643 for a non-hands-free operation, a microphone amplifier 644 for a non-hands-free operation, a microphone switching control section 645, and an A/D converter 646.

The microphone switching control section 645 controls switching between the hands-free analog system and the non-hands-free analog system in accordance with a control command 653 for switching the hands-free/non-hands-free operations.

The A/D converter 646 receives an analog speech signal from the analog system selected by the switching control of the microphone switching control section 645, and digitizes the analog speech signal to produce speech data.

In the non-hands-free operation, the direction of arrival of speech and the distance of travel of speech are substantially invariable. Thus, a microphone having sensitivity and directivity meeting this condition is used. On the other hand, in the hands-free operation, a microphone needs to have a higher sensitivity so that speech from afar may be captured. In addition, since the direction of arrival speech is variable, the directivity of the microphone needs to be increased. Thus, the characteristics of the analog speech signal delivered to the A/D converter 646 are different between the hands-free operation and the non-hands-free operation.

An echo control unit 630 comprises a hands-free echo control section 631, a non-hands-free echo control section 632, and an echo switching control section 633.

The hands-free echo control section 631 is suitable when the hands-free microphone 641 and hands-free microphone amplifier 642 are used. The hands-free echo control section 631 reduces echo superimposed on the speech data output from the A/D converter 646.

On the other hand, the non-hands-free echo control section 632 is suitable when the non-hands-free microphone 643 and non-hands-free microphone amplifier 644 are used. The non-hands-free echo control section 632 reduces echo superimposed on the speech data output from the A/D converter 646. However, where echo suppression is not needed, the speech data is directly output without echo control.

The echo switching control section 633 controls switching between the hands-free echo control section 631 and non-hands-free echo control section 632 in accordance with the control command 653 for switching the hands-free/non-hands-free operations, so that the selected one of the echo control sections 631 and 632 may receive the speech data from the A/D converter 646.

With this control, speech data 651, which has been echo-reduced by the hands-free echo control section 631 or non-hands-free echo control section 632, is output to a noise suppressor 610.

The noise suppressor 610 comprises a noise suppress section 615, a parameter table 616 and a parameter switching control section 617.

The noise suppress section 615 suppresses background noise contained in speech data output from the echo control unit 630. The suppression characteristics for background noise suppression are controlled by parameters input from the parameter table 616.

The parameter table 616 stores parameters for setting the characteristics for background noise suppression to be effected by the noise suppress section 615. Specifically, the parameter table 616 stores a parameter set A which is optimal for the hands-free operation, and a parameter set B which is optimal for the non-hands-free operation. An optimal one of the parameter sets is input to the noise suppress section 615 by the control of the parameter switching control section 617.

The parameter set A provides characteristics suitable for noise suppression of the speech data 651 which is generated through the hands-free microphone 641, hands-free microphone amplifier 642 and hands-free echo control section 631, which are used in the hands-free operation.

On the other hands, the parameter set B provides characteristics suitable for noise suppression of the speech data 651 which is generated through the non-hands-free microphone 643, non-hands-free microphone amplifier 644 and non-hands-free echo control section 632, which are used in the non-hands-free operation.

The parameter switching control section 617 controls the parameter table 616. Thus, based on the control command 653 for switching the hands-free/non-hands-free operations, one of the parameter sets, which is optimal for the noise suppression of the speech data 651, can be selectively set in the noise suppress section 615.

Figure 24:
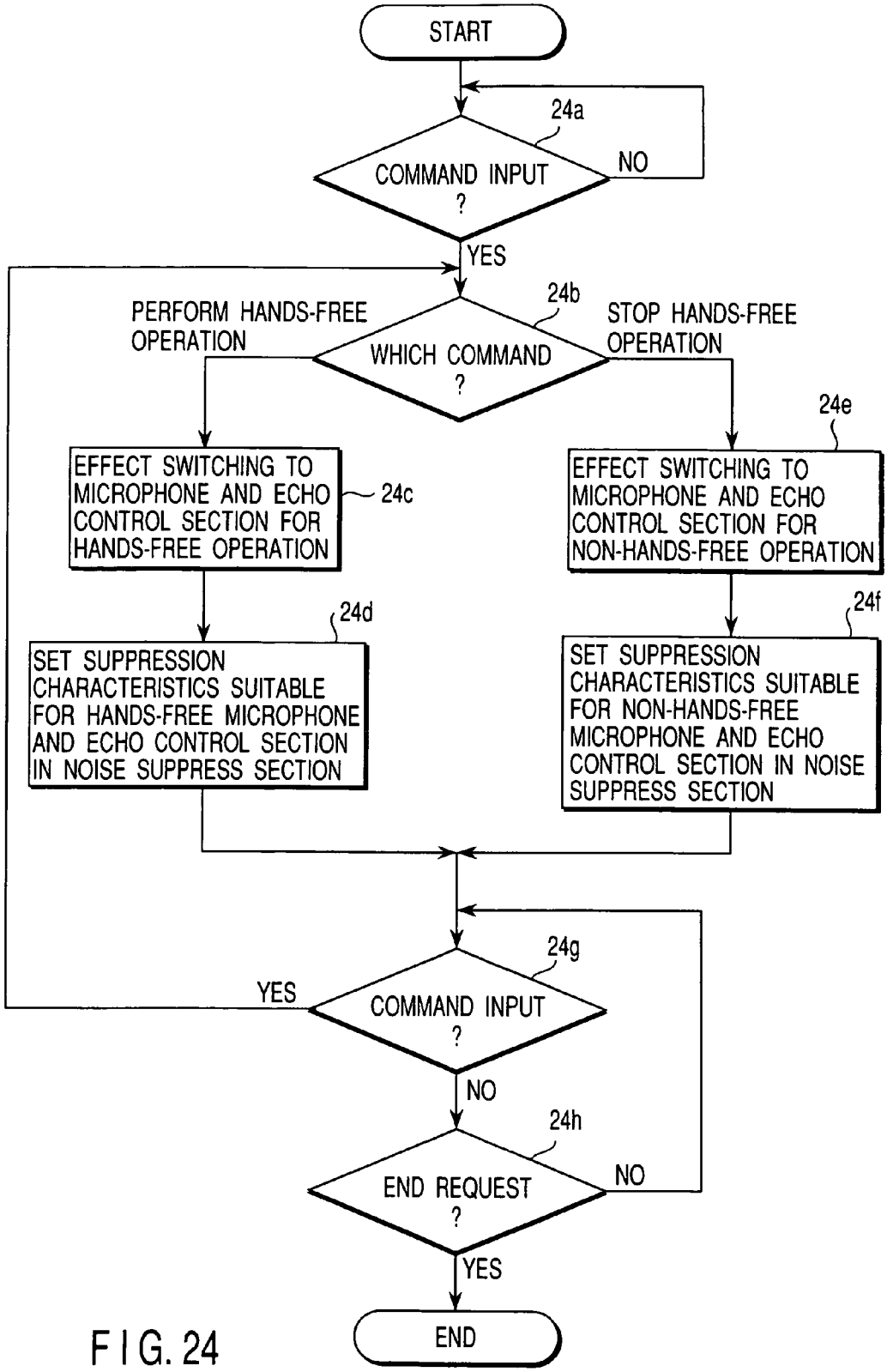
FIG. 24 is a flow chart illustrating the operation of the signal processing apparatus according to the sixth embodiment shown in FIG. 23.

The operation of the signal processing apparatus according to the sixth embodiment will now be described. FIG. 24 is a flow chart illustrating this operation.

In a command input standby state in step 24*a*, if the control command 653 to the effect that "Perform hands-free operation" has been input, control advances to step 24*b* to determine the content of the input command. Since the input command relates to the start of the hands-off operation, control goes to step 24*c*.

In step 24*c*, the microphone switching control section 645 begins a switching control so that the analog speech signal coming from the hands-free microphone 641 and hands-free microphone amplifier 642 may be input to the A/D converter 646.

In step 24*c*, in parallel with the switching control, the echo switching control section 633 effects switching according to the control command 653 so that the speech data from the A/D converter 646 may be input to the hands-free echo control section 631. Control then goes to step 24*d*.

In step 24*d*, according to the control command 653, the parameter switching control section 617 controls the parameter table 616 and sets the optimal parameter set A for the hands-free operation in the noise suppress section 615. Control then goes to step 24*g*.

Accordingly, where the hands-free operation command is input, the above switching control is effected and the user's speech input from the hands-free microphone 641 is subjected in the hands-free echo control section 631 to the echo control suitable for the case where the hands-free microphone 641 and hands-free microphone amplifier 642 are used.

The echo-controlled speech data 651 is subjected in the noise suppress section 615, in which the parameter set A is set, to the noise suppression process optimal for the case where the hands-free microphone 641, hands-free microphone amplifier 642 and hands-free echo control section 631 are used. The resultant data is output to the transmission section at the rear stage as transmission speech data 652.

In step 24*g*, if the control command 653 to the effect that "Stop the hands-free operation" is input, control goes to step 24*b* to determine the content of the input command. Since the input command relates to the stop of the hands-free operation, control goes to step 24*e*.

In step 24*e*, the microphone switching control section 645 begins a switching control so that the analog speech signal coming from the non-hands-free microphone 643 and non-hands-free microphone amplifier 644 may be input to the A/D converter 646.

In step 24*e*, in parallel with the switching control, the echo switching control section 633 effects switching according to the control command 653 so that the speech data from the A/D converter 646 may be input to the non-hands-free echo control section 632. Control then goes to step 24*f*.

In step 24*f*, according to the control command 653, the parameter switching control section 617 controls the parameter table 616 and sets the optimal parameter set B for the non-hands-free operation in the noise suppress section 615. Control then goes to step 24*g*.

Accordingly, where the command for stopping the hands-free operation is input, the above switching control is effected and the user's speech input from the non-hands-free microphone 643 is subjected in the non-hands-free echo control section 632 to the echo control suitable for the case where the non-hands-free microphone 643 and non-hands-free microphone amplifier 644 are used.

The echo-controlled speech data 651 is subjected in the noise suppress section 615, in which the parameter set B is set, to the noise suppression process optimal for the case where the non-hands-free microphone 643, non-hands-free microphone amplifier 644 and non-hands-free echo control section 632 are used. The resultant data is output to the transmission section at the rear stage as transmission speech data 652.

In step 24*g*, if no command is input, control goes to step 24*h*. In step 24*h*, it is determined whether a communication end request is input. If the communication end request has been input, the present process is finished. If the communication end request is not input, command input is monitored once again in step 24*g*.

As has been described above, in the signal processing apparatus having the above structure, when the echo-controlled, noise-suppressed transmission speech data 652 is to be acquired, the noise suppress section 615 is controlled to have optimal noise suppression characteristics in accordance with the hands-free/non-hands-free speech data generation path.

According to the signal processing apparatus with the above structure, noise suppression is effected by the noise suppress section suitable for the speech data generation path, i.e. speech data characteristics, even if the hands-free operation and non-hands-free operation are switched. Thus, the noise suppress section functions with high performance, and high-quality speech can be transmitted.

The present invention is not limited to the above-described embodiments. In each embodiment, the noise suppressor, speech coder (decoder), echo control unit, etc. are described as separate sections. However, in each embodiment, these elements may be integrated on a chip. Thus, the invention can be realized on a single DSP chip.

Alternatively, needless to say, it is possible to use a high-speed processor and a memory, to store in the memory a program exhibiting functions of the noise suppressor, speech coder (decoder), echo control unit, etc., and to activate the processor according to this program.

Of course, other modifications may be made to the present invention without departing from the spirit of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A signal processing apparatus comprising:

a noise suppressor having a plurality of different noise suppression characteristics for suppressing background noise contained in a speech signal, where a number of the noise suppression characteristics is Q (Q: a positive integer);

a speech encoder having a plurality of different speech coding algorithms for encoding an output signal from the noise suppressor, where a number of the speech coding algorithms is P (P: positive integer and $P \geqq Q > 1$);

means for selecting one of the plurality of noise suppression characteristics and one of the plurality of speech coding algorithms based upon a select command; and control means for activating the noise suppressor with the selected noise suppression characteristic and the speech encoder with the selected speech coding algorithm, wherein the speech signal is encoded by using the noise suppressor and the speech encoder activated by the control means.

2. The signal processing apparatus according to claim 1, wherein one of the speech coding algorithms is the AMR standard or the EVRC standard.

3. A signal processing apparatus comprising:

a noise suppressor having a plurality of different noise suppression characteristics for suppressing background noise contained in a speech signal, where a number of the noise suppression characteristics is Q (Q: a positive integer);

a speech encoder having a plurality of different speech coding rates for encoding an output signal from the noise suppressor, where a number of the speech coding rates is R (R: positive integer and $R \geqq Q > 1$);

means for selecting one of the plurality of noise suppression characteristics and one of the plurality of speech coding rates based upon a select command; and control means for activating the noise suppressor with the selected noise suppression characteristic and the speech encoder with the selected speech coding rate, wherein the speech signal is encoded by using the noise suppressor and the speech encoder activated by the control means.

4. A signal processing apparatus comprising:

a parameter table configured to store a plurality of parameter sets for characterizing a noise suppressor, where a number of the parameter sets is S (S: a positive integer);

a noise suppressor, whose noise suppression characteristic is varied in accordance with the parameter set, configured to suppress background noise contained in a speech signal;

a speech encoder having a plurality of different speech coding algorithms for encoding an output signal from the noise suppressor, where a number of the speech coding algorithms is P (P: positive integer and $P \geqq S > 1$);

means for selecting one of the plurality of parameter sets and one of the plurality of speech coding algorithms based upon a select command; and control means for activating the noise suppressor with the noise suppression characteristic in accordance with the selected parameter set and the speech encoder with the selected speech coding algorithm, wherein the speech signal is encoded by using the noise suppressor and the speech encoder activated by the control means.

5. The signal processing apparatus according to claim 4, wherein one of the speech coding algorithms is the AMR standard or the EVRC standard.

6. A signal processing apparatus comprising:

a parameter table configured to store a plurality of parameter sets for characterizing a noise suppressor, where a number of the parameter sets is S (S: a positive integer);

a noise suppressor, whose noise suppression characteristic is varied in accordance with the parameter set, configured to suppress background noise contained in a speech signal;

a speech encoder having a plurality of different speech coding rates for encoding an output signal from the noise suppressor, where a number of the speech coding rates is R (R: positive integer and $R \geqq S > 1$);

means for selecting one of the plurality of parameter sets and one of the plurality of speech coding rates based upon a select command; and control means for activating the noise suppressor with the noise suppression characteristic in accordance with the selected parameter set and the speech encoder with the selected speech coding rate, wherein the speech signal is encoded by using the noise suppressor and the speech encoder activated by the control means.

7. A signal processing apparatus comprising:

a noise suppressor having a plurality of different noise suppression algorithms for suppressing background noise contained in a speech signal, where a number of the noise suppression algorithms is Q (Q: a positive integer);

a speech encoder having a plurality of different speech coding algorithms for encoding an output signal from the noise suppressor, where a number of the speech coding algorithms is P (P: positive integer and $P \geqq Q > 1$);

means for selecting one of the plurality of noise suppression algorithms and one of the plurality of speech coding algorithms based upon a select command; and control means for activating the noise suppressor with the selected noise suppression algorithm and the speech encoder with the selected speech coding algorithm, wherein the speech signal is encoded by using the noise suppressor and the speech encoder activated by the control means.

8. The signal processing apparatus according to claim 7, wherein one of the speech coding algorithms is the AMR standard or the EVRC standard.

9. A signal processing apparatus comprising:

a noise suppressor having a plurality of different noise suppression algorithms for suppressing background noise contained in a speech signal, where a number of the noise suppression algorithms is Q (Q: a positive integer);

a speech encoder having a plurality of different speech coding rates for encoding an output signal from the noise suppressor, where a number of the speech coding rates is R (R: positive integer and $R \geqq Q > 1$);

means for selecting one of the plurality of noise suppression algorithms and one of the plurality of speech coding rates based upon a select command; and control means for activating the noise suppressor with the selected noise suppression algorithm and the speech encoder with the selected speech coding rate, wherein the speech signal is encoded by using the noise suppressor and the speech encoder activated by the control means.

10. A mobile communication terminal having a signal processor, the signal processor comprising:

a microphone configured to capture a speech signal;

a noise suppressor having a plurality of different noise suppression characteristics for suppressing background noise contained in the speech signal, where a number of the noise suppression characteristics is Q (Q: a positive integer);

a speech encoder having a plurality of different speech coding algorithms for encoding an output signal from the noise suppressor, where a number of the speech coding algorithms is P (P: positive integer and $P \geqq Q > 1$);

means for selecting one of the plurality of noise suppression characteristics and one of the plurality of speech coding algorithms based upon a select command; and control means for activating the noise suppressor with the selected noise suppression characteristic and the speech encoder with the selected speech coding algorithm, wherein the speech signal is encoded by using the noise suppressor and the speech encoder activated by the control means.

11. A mobile communication comprising:

a signal processor, the signal processor comprising:

a microphone configured to capture a speech signal;

a noise suppressor having a plurality of different noise suppression characteristics for suppressing background noise contained in the speech signal, where a number of the noise suppression characteristics is Q (Q: a positive integer);

a speech encoder having a plurality of different speech coding rates for encoding an output signal from the noise suppressor, where a number of the speech coding rates is R (R: positive integer and R≧Q>1);

means for selecting one of the plurality of noise suppression characteristics and one of the plurality of speech coding rates based upon a select command; and control means for activating the noise suppressor with the selected noise suppression characteristic and the speech encoder with the selected speech coding rate, wherein the speech signal is encoded by using the noise suppressor and the speech encoder activated by the control means.

12. A mobile communication terminal comprising:

a signal processor, the signal processor comprising:

a microphone configured to capture a speech signal;

a parameter table configured to store a plurality of parameter sets for characterizing a noise suppressor, where a number of the parameter sets is S (S: a positive integer);

a noise suppressor, whose noise suppression characteristic is varied in accordance with the parameter set, configured to suppress background noise contained in the speech signal;

a speech encoder having a plurality of different speech coding algorithms for encoding an output signal from the noise suppressor, where a number of the speech coding algorithms is P (P: positive integer and P≧S>1);

means for selecting one of the plurality of parameter sets and one of the plurality of speech coding algorithms based upon a select command; and control means for activating the noise suppressor with the noise suppression characteristic in accordance with the selected parameter set and the speech encoder with the selected speech coding algorithm, wherein the speech signal is encoded by using the noise suppressor and the speech encoder activated by the control means.

13. The mobile communication terminal according to claim 12, wherein one of the speech coding algorithms is the AMR standard or the EVRC standard.

14. A mobile communication terminal comprising:

a signal processor, the signal processor comprising:

a microphone configured to capture a speech signal;

a parameter table configured to store a plurality of parameter sets for characterizing a noise suppressor, where a number of the parameter sets is S (S: a positive integer);

a noise suppressor, whose noise suppression characteristic is varied in accordance with the parameter set, configured to suppress background noise contained in the speech signal;

a speech encoder having a plurality of different speech coding rates for encoding an output signal from the noise suppressor, where a number of the speech coding rates is R (R: positive integer and R≧S>1);

means for selecting one of the plurality of parameter sets and one of the plurality of speech coding rates based upon a select command; and control means for activating the noise suppressor with the noise suppression characteristic in accordance with the selected parameter set and the speech encoder with the selected speech coding rate, wherein the speech signal is encoded by using the noise suppressor and the speech encoder activated by the control means.

15. A mobile communication terminal comprising:

a signal processor, the signal processor comprising:

a microphone configured to capture a speech signal;

a noise suppressor having a plurality of different noise suppression algorithms for suppressing background noise contained in the speech signal, where a number of the noise suppression algorithms is Q (Q: a positive integer);

a speech encoder having a plurality of different speech coding algorithms for encoding an output signal from the noise suppressor, where a number of the speech coding algorithms is P (P: positive integer and P≧Q>1);

means for selecting one of the plurality of noise suppression algorithms and one of the plurality of speech coding algorithms based upon a select command; and control means for activating the noise suppressor with the selected noise suppression algorithm and the speech encoder with the selected speech coding algorithm, wherein the speech signal is encoded by using the noise suppressor and the speech encoder activated by the control means.

16. The mobile communication terminal according to claim 15, wherein one of the speech coding algorithms is the AMR standard or the EVRC standard.

17. A mobile communication terminal comprising:

a signal processor, the signal processor comprising:

a microphone configured to capture a speech signal;

a noise suppressor having a plurality of different noise suppression algorithms for suppressing background noise contained in the speech signal, where a number of the noise suppression algorithms is Q (Q: a positive integer);

a speech encoder having a plurality of different speech coding rates for encoding an output signal from the noise suppressor, where a number of the speech coding rates is R (R: positive integer and R≧Q>1);

means for selecting one of the plurality of noise suppression algorithms and one of the plurality of speech coding rates based upon a select command; and control means for activating the noise suppressor with the selected noise suppression algorithm and the speech encoder with the selected speech coding rate, wherein the speech signal is encoded by using the noise suppressor and the speech encoder activated by the control means.

18. The mobile communication terminal according to claim 10, wherein one of the speech coding algorithms is the AMR standard or the EVRC standard.

19. A signal processing apparatus comprising:

a plurality of noise suppressors;

a plurality of speech encoders; and means for selecting one of the plurality of noise suppressors and one of the plurality of speech encoders, wherein a background noise contained in an input speech signal is suppressed by using the selected noise suppressor and an output signal from the noise suppressor is encoded using the selected speech encoder.

20. The signal processing apparatus according to claim 19, wherein at least two of the plurality of the noise suppressors have noise suppression characteristics different from each other and at least two of the plurality of the speech encoders have speech coding algorithms different from each other.

21. A mobile communication terminal comprising:

a signal processor, the signal processor comprising:

a microphone configured to capture a speech signal;

a plurality of noise suppressors;

a plurality of speech encoders; and means for selecting one of the plurality of noise suppressors and one of the plurality of speech encoders, wherein a background noise contained in the speech signal is suppressed by using the selected noise suppressor and an output signal from the noise suppressor is encoded using the selected speech encoder.

22. The mobile communication terminal according to claim 21, wherein at least two of the plurality of the noise suppressors have noise suppression characteristics different from each other and at least two of the plurality of the speech encoders have speech coding algorithms different from each other.

23. A signal processing apparatus comprising:

a plurality of noise suppressor programs;

a plurality of speech encoder programs;

means for selecting one of the plurality of noise suppressor programs and one of the plurality of speech encoder programs;

means for suppressing a background noise contained in a speech signal by using the selected noise suppressor program; and means for encoding an output signal from the noise suppression means by using the selected speech encoder program.

24. A mobile communication terminal comprising:

a signal processor, the signal processor comprising:

a microphone configured to capture a speech signal;

a plurality of noise suppressor programs;

a plurality of speech encoder programs;

means for selecting one of the plurality of noise suppressor programs and one of the plurality of speech encoder programs;

means for suppressing a background noise contained in a speech signal by using the selected noise suppressor program; and means for encoding an output signal from the noise suppression means by using the selected speech encoder program.

25. A signal processing apparatus comprising:

a plurality of speech decoders;

a plurality of noise suppressors; and means for selecting one of the plurality of speech decoders and one of the plurality of noise suppressors, wherein a speech signal is decoded by using the selected speech decoder and a background noise contained in the speech signal is suppressed by using the selected noise suppressor.

26. A signal processing apparatus comprising:

a plurality of speech decoder programs;

a plurality of noise suppressor programs;

means for selecting one of the plurality of speech decoder programs and one of the plurality of noise suppressor programs;

means for decoding a speech signal by using the selected speech decoder program; and means for suppressing a background noise contained in the speech signal by using the selected noise suppressor program.

* * * * *